US007486905B2

(12) United States Patent
Nishimura et al.

(10) Patent No.: US 7,486,905 B2
(45) Date of Patent: Feb. 3, 2009

(54) DEVELOPER CARTRIDGE INCLUDING DEVELOPER FILLING PORT CAP AND RECYCLING METHOD THEREOF

(75) Inventors: Soichiro Nishimura, Handa (JP); Masatoshi Sakaguchi, Gifu (JP); Mitsuru Horinoe, Chita-gun (JP); Fumikazu Sato, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 310 days.

(21) Appl. No.: 11/338,963

(22) Filed: Jan. 25, 2006

(65) Prior Publication Data

US 2006/0171737 A1 Aug. 3, 2006

(30) Foreign Application Priority Data

Jan. 28, 2005 (JP) ..... 2005-021990
Mar. 30, 2005 (JP) ..... 2005-098440

(51) Int. Cl.
*G03G 15/08* (2006.01)

(52) U.S. Cl. ..... 399/106; 399/109

(58) Field of Classification Search ..... 399/106, 399/109, 262

See application file for complete search history.

(56) References Cited

U.S. PATENT DOCUMENTS 5,812,915 A * 9/1998 Farkash ..... 399/262
5,870,652 A 2/1999 Kanamori et al.
5,983,059 A * 11/1999 Oka et al. ..... 399/109
6,131,008 A 10/2000 Kanamori et al.
6,219,506 B1 4/2001 Morinaga et al.
6,246,848 B1 * 6/2001 Morinaga et al. ..... 399/106
7,139,505 B2 * 11/2006 Askren et al. ..... 399/106
2005/0028492 A1 2/2005 Nagashima et al.

FOREIGN PATENT DOCUMENTS

| | | |
|---|---|---|
| JP | A 4-475 | 1/1992 |
| JP | A 7-261524 | 10/1995 |
| JP | A 9-222839 | 8/1997 |
| JP | A 9-258537 | 10/1997 |
| JP | A 2000-137375 | 5/2000 |
| JP | A 2001-22219 | 1/2001 |
| JP | A 2002-351199 | 12/2002 |
| JP | A 2004-317549 | 11/2004 |

* cited by examiner

*Primary Examiner*—William J Royer
(74) *Attorney, Agent, or Firm*—Oliff & Berridge, PLC

(57) ABSTRACT

A cartridge includes: a casing having a wall defining a developer accommodating portion inside the casing, a filling port being formed through the wall in fluid communication with the developer accommodating portion; a cylindrical wall portion formed on the wall at a circumferential edge of the filling port and protruding from the wall outside the casing, the cylindrical wall portion having an inner peripheral surface, an outer peripheral surface, and an end surface positioned between the inner peripheral surface and the outer peripheral surface; a closure member which is fitted in the cylindrical wall portion, while being in contact with the inner peripheral surface of the cylindrical wall portion, to close the filling port; and a protruding portion that is provided on at least one of the end surface and the closure member at its contact portion between the end surface and the closure member and that protrudes toward the other one of the end surface and the closure member.

62 Claims, 17 Drawing Sheets

DEVELOPER CARTRIDGE INCLUDING DEVELOPER FILLING PORT CAP AND RECYCLING METHOD THEREOF

CROSS REFERENCE TO RELATED APPLICATIONS

This application claims priority to Japanese Patent Application Nos. 2005-21990 filed on Jan. 28, 2005 and 2005-98440 filed on Mar. 30, 2005. The entire content of each of these applications is incorporated herein by reference.

TECHNICAL FIELD

The disclosure relates to a developer cartridge which contains a developer, and a recycling method thereof.

BACKGROUND

Conventionally, a developer cartridge having a toner accommodating chamber for containing toner is detachably attached to an image forming apparatus such as a laser printer.

A filling port for filling toner in the toner accommodating chamber is formed in a casing of the developer cartridge. After filling toner into the toner accommodating chamber through the filling port, a cap is attached to the filling port. The filling port is thus closed so that the toner filled in the toner accommodating chamber will not leak.

The developer cartridge is detached from the image forming apparatus when the toner in the toner accommodating chamber is consumed. The developer cartridge is replaced with another developer cartridge that is filled with toner. In order to recycle the developer cartridge detached from the image forming apparatus, the cap is first detached from the filling port of the developer cartridge. Then, toner is refilled in the developer cartridge. After refilling the toner, the cap is attached again.

For example, Japanese Unexamined Patent Application Publication No. 9-258537 proposes the following method of recycling a developer cartridge: First, a sealing cap that is fixed to a toner filling port is detached. Then, toner is refilled into the toner accommodating chamber through the opened toner filling port. Thereafter, a cap is fixed to the toner filling port. That is, the cap may be bonded to the toner filling port by an adhesive agent, pressingly fitted into the toner filling port, detachably screwed into the toner filling port, or detachably pressingly fitted into the toner filling port via a packing member.

Japanese Unexamined Patent Application Publication No. 9-222839 proposes attaching a closure member to the toner filling port of a toner container in the developer cartridge via ultrasonic welding.

SUMMARY

However, when the sealing cap is bonded to the toner filling port by an adhesive agent, the sealing cap is difficult to be detached from the toner filling port. Similarly, when the sealing cap is ultrasonically welded to the toner filling port, it is impossible to detach the sealing cap from the toner filling port.

When a sealing cap is pressingly fitted in the toner filling port, the sealing cap is firmly pressed in the toner filling port in order to prevent the leakage of toner. Therefore, the toner filling port will possibly be damaged when the sealing cap is detached from the toner filling port. If the sealing cap is pressed in the damaged toner filling port again, toner leakage will occur from a damaged part of the toner filling port.

U.S. Pat. No. 6,219,506 proposes a method of facilitating detachment of a cap from the filling port when the cap is pressingly fitted in the filling port. According to this method, a slit is cut in the cap pressed in the filling port. The cap is once bent or warped in the filling port thereby to lower the rigidity of the cap. Then, the cap is detached from the filling port.

However, the cap cannot always be detached from the periphery of the filling port by cutting and warping the cap. Particularly in case where the cap has been fixed to the periphery of the filling port by an adhesive, the cap is not peeled off of the periphery of the filling port even by warping the cap. If the cap is forced to be removed from the filling port with the cap fit on the periphery of the filling port, the periphery of the filling port is damaged. This results in that the sealing performance deteriorates when the filling port is closed after refilling toner.

In order to close the filling port after refilling the toner, the cap may be pressed again in the filling port. In this case, it becomes difficult to know whether the developer cartridge is a new product or a recycled product subjected to refilling of toner. For example, a recycled product which has once been refilled with toner may further be recycled. When a recycled developer cartridge is further recycled, some components in the developer cartridge have to be replaced with new ones. Examples of those components are: a development roller for supplying toner to a photosensitive drum, and a sealing member for preventing leakage of toner from a periphery of the development roller. If whether a developer cartridge is a new product or a recycled product cannot be distinguished, it becomes necessary to check fatigue of these components in every developer cartridge that is to be recycled.

In view of the foregoing problems, it is an object of the present invention to provide a cartridge, from which a cap can be detached without damaging the filling port, which is capable of preventing occurrence of toner leakage from the toner filling port after refilling the toner, and which makes it possible to determine whether or not the cartridge has been subjected to refilling, and a recycling method thereof.

In order to attain the above and other objects, the present invention provides a cartridge, including: a casing having a wall defining a developer accommodating portion inside the casing, a filling port being formed through the wall in fluid communication with the developer accommodating portion, developer being introduced through the filling port into the developer accommodating portion; a cylindrical wall portion formed on the wall at a circumferential edge of the filling port and protruding from the wall outside the casing, the cylindrical wall portion having an inner peripheral surface, an outer peripheral surface, and an end surface positioned between the inner peripheral surface and the outer peripheral surface; a closure member which is fitted in the cylindrical wall portion, while being in contact with the inner peripheral surface of the cylindrical wall portion, to close the filling port; and a protruding portion that is provided on at least one of the end surface and the closure member at its contact portion between the end surface and the closure member and that protrudes toward the other one of the end surface and the closure member.

According to another aspect, the invention provides a cartridge, including: a casing having a wall defining a developer accommodating portion inside the casing, a filling port being formed through the wall in fluid communication with the developer accommodating portion, developer being introduced through the filling port into the developer accommodating portion; a cylindrical wall portion formed on the wall at a circumferential edge of the filling port and protruding from the wall outside the casing; and a closure member that closes the cylindrical wall portion to close the filling port, the closure member having a flange portion, the flange portion having a contact portion that contacts an end surface of the cylindrical wall portion and an extending portion that extends radially outwardly from the cylindrical wall portion.

According to another aspect, the invention provides a cartridge, including: a casing having a wall defining a developer accommodating portion inside the casing, a filling port being formed through the wall in fluid communication with the developer accommodating portion, developer being introduced through the filling port into the developer accommodating portion; a cylindrical wall portion formed on the wall at a circumferential edge of the filling port and protruding from the wall outside the casing; a closure member, whose part is inserted in the cylindrical wall portion while contacting at least a part of the cylindrical wall portion to close the filling port, the cylindrical wall portion having a through-hole at at least a part of its portion where the cylindrical wall portion contacts the closure member, thereby allowing the closure member to be exposed through the through-hole; and a protruding wall formed on the wall at a position opposing the through-hole in the cylindrical wall portion and protruding from the wall outside the casing.

According to another aspect, the invention provides a cartridge, including: a casing having a wall defining a developer accommodating portion inside the casing, a filling port being formed through the wall in fluid communication with the developer accommodating portion, developer being introduced through the filling port into the developer accommodating portion; a cylindrical wall portion formed on the wall at a circumferential edge of the filling port and protruding from the wall outside the casing; and a closure member that closes the cylindrical wall portion to close the filling port, the closure member being pressingly inserted in the cylindrical wall portion after the developer is filled in the developer accommodating portion for the first time, and the closure member being ultrasonically welded to the cylindrical wall portion after the developer is refilled in the developer accommodating portion for recycle use.

According to another aspect, the invention provides a method of using a cartridge, the method including: preparing a cartridge including a casing having a wall defining a developer accommodating portion inside the casing, a filling port being formed through the wall in fluid communication with the developer accommodating portion, and a cylindrical wall portion formed on the wall at a circumferential edge of the filling port and protruding from the wall outside the casing; filling developer in the developer accommodating portion through the filling port for the first time; pressingly inserting a closure member in the cylindrical wall portion to close the filling port after developer is filled in the developer accommodating portion for the first time; removing the closure member from the cylindrical wall portion and refilling the developer in the developer accommodating portion through the opened filling port; refilling developer in the developer accommodating portion through the filling port for recycle use; and pressingly inserting the closure member in the cylindrical wall portion and ultrasonically welding the closure member to the cylindrical wall portion to close the filling port after the developer is refilled in the developer accommodating portion for recycle use.

According to another aspect, the invention provides a method of recycling a used cartridge, the method comprising: collecting a used cartridge including a casing having a wall defining a developer accommodating portion inside the casing, a filling port being formed through the wall in fluid communication with the developer accommodating portion, developer being filled in the developer accommodating portion through the filling port, and a cylindrical wall portion formed on the wall at a circumferential edge of the filling port and protruding from the wall outside the casing, a closure member being pressingly inserted in the cylindrical wall portion to close the filling port; removing the closure member from the cylindrical wall portion and refilling the developer in the developer accommodating portion through the opened filling port; refilling developer in the developer accommodating portion through the filling port for recycle use; and pressingly inserting the closure member in the cylindrical wall portion and ultrasonically welding the closure member to the cylindrical wall portion to close the filling port after the developer is refilled in the developer accommodating portion for recycle use.

According to another aspect, the invention provides a cartridge, including: a casing having a wall defining a developer accommodating portion inside the casing, a filling port being formed through the wall in fluid communication with the developer accommodating portion, developer being introduced through the filling port into the developer accommodating portion; and a receiving member provided on the wall, the receiving member having a first contact surface that receives a first cap member while in contact therewith to close the filling port when the first cap member is used to close the filling port, the receiving member further having a second contact surface that receives a second cap member while in contact therewith to close the filling port when the second cap member is used to close the filling port.

According to another aspect, the invention provides a combination of a cartridge, a first cap member, and a second cap member, including: a cartridge including: a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing; a first cap member mounted on one of inner and outer peripheral surfaces of the cylindrical wall portion; and a second cap member mounted on the other one of inner and outer peripheral surfaces of the cylindrical wall portion.

According to another aspect, the invention provides a combination of a cartridge, a first cap member, and a second cap member, including: a cartridge including: a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing, the cylindrical wall portion having a groove on its outer peripheral surface in its axial tip end part, the groove extending along an axis of the cylindrical wall portion; a first cap member mounted on an inner peripheral surface of the cylindrical wall portion at its axial tip end part; and a second cap member mounted on the inner peripheral surface of the cylindrical wall portion at its axial base end part.

According to another aspect, the invention provides a combination of a cartridge, a first cap member, and a second cap member, including: a cartridge including: a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing, the cylindrical wall portion having a base-end-side part on an axial base end side thereof and a tip-end-side part on an axial tip end side thereof, the tip-end-side part being thinner than the base-end-side part; a first cap member mounted on an inner peripheral surface of the tip-end-side part of the cylindrical wall portion; and a second cap member mounted on the inner peripheral surface of the base-end-side part of the cylindrical wall portion.

According to another aspect, the invention provides a cartridge, including: a casing having a wall defining a developer accommodating portion inside the casing, a filling port being formed through the wall in fluid communication with the developer accommodating portion, developer being introduced through the filling port into the developer accommodating portion; and an inner cylindrical wall portion provided on the wall to protrude from a circumferential edge of the filling port in a direction outside the casing; and an outer cylindrical wall portion provided on the wall to protrude in a direction outside the casing, the outer cylindrical wall portion surrounding the inner cylindrical wall portion.

According to another aspect, the invention provides a cap member, including: a hollow cylindrical portion; a flange portion extending radially outwardly from one axial end of the cylindrical portion; and a bottom portion closing the other axial end of the cylindrical portion and having a groove along a circumferential edge of the bottom portion.

According to another aspect, the invention provides a method of recycling a used cartridge, the method comprising: collecting a used cartridge including a casing having a wall defining a developer accommodating portion inside the casing, a filling port being formed through the wall in fluid communication with the developer accommodating portion, and a receiving member provided on the wall, the receiving member having a first contact surface and a second contact surface, a first cap member being received on the receiving member while being in contact with the first contact surface and closing the filling port; removing at least a part of the first cap member to open the filling port; refilling developer in the developer accommodating portion through the opened filling port; and bringing a second cap member into contact with the second contact surface after refilling the developer in the developer accommodating portion, to thereby close the filling port.

According to another aspect, the invention provides a method of using a cartridge, the method comprising: preparing a cartridge including a casing having a wall defining a developer accommodating portion inside the casing, a filling port being formed through the wall in fluid communication with the developer accommodating portion, and a receiving member provided on the wall, the receiving member having a first contact surface and a second contact surface; filling developer in the developer accommodating portion through the opened filling port; bringing a first cap member into contact with the first contact surface after filling the developer in the developer accommodating portion, to thereby close the filling port; removing at least a part of the first cap member, to open the filling port; refilling developer in the developer accommodating portion through the opened filling port; and bringing a second cap member into contact with the second contact surface after refilling the developer in the developer accommodating portion, to thereby close the filling port.

According to another aspect, the invention provides a method of using a cartridge, the method including: preparing a cartridge including a casing having a wall defining a developer accommodating portion inside the casing, a filling port being formed through the wall in fluid communication with the developer accommodating portion, and at least one cylindrical wall portion protruding from the wall in a direction outside the casing and surrounding the filling port, the at least one cylindrical wall portion including a first cylindrical wall portion; filling developer in the developer accommodating portion through the opened filling port; after filling the developer in the developer accommodating portion, pressingly fitting a first cap member into one of the at least one cylindrical wall portion, while bringing the first cap member into contact with a first part in a surface of the first cylindrical wall portion, to thereby close the filling port; removing at least a part of the first cap member, to open the filling port; refilling developer in the developer accommodating portion through the opened filling port; selecting either one of the first cap member and a second cap member different from the first cap member; and after refilling the developer, mounting the selected cap member into either one of the at least one cylindrical wall portion in a manner that when the selected cap member is the first cap member, the first cap member is pressingly inserted into the first cylindrical wall portion and is ultrasonically welded to the first cylindrical wall portion and that when the selected cap member is the second cap member, the second cap member is pressingly inserted into one of the at least one cylindrical wall portion, while bringing the second cap member into contact with a second part in a surface of the either one of the at least one cylindrical wall portion, the second part being different from the first part, to thereby close the filling port.

DETAILED DESCRIPTION

A cartridge according to the embodiments of the invention will be described with reference to the accompanying drawings.

<Overall Structure of Laser Printer>

Figure 1:
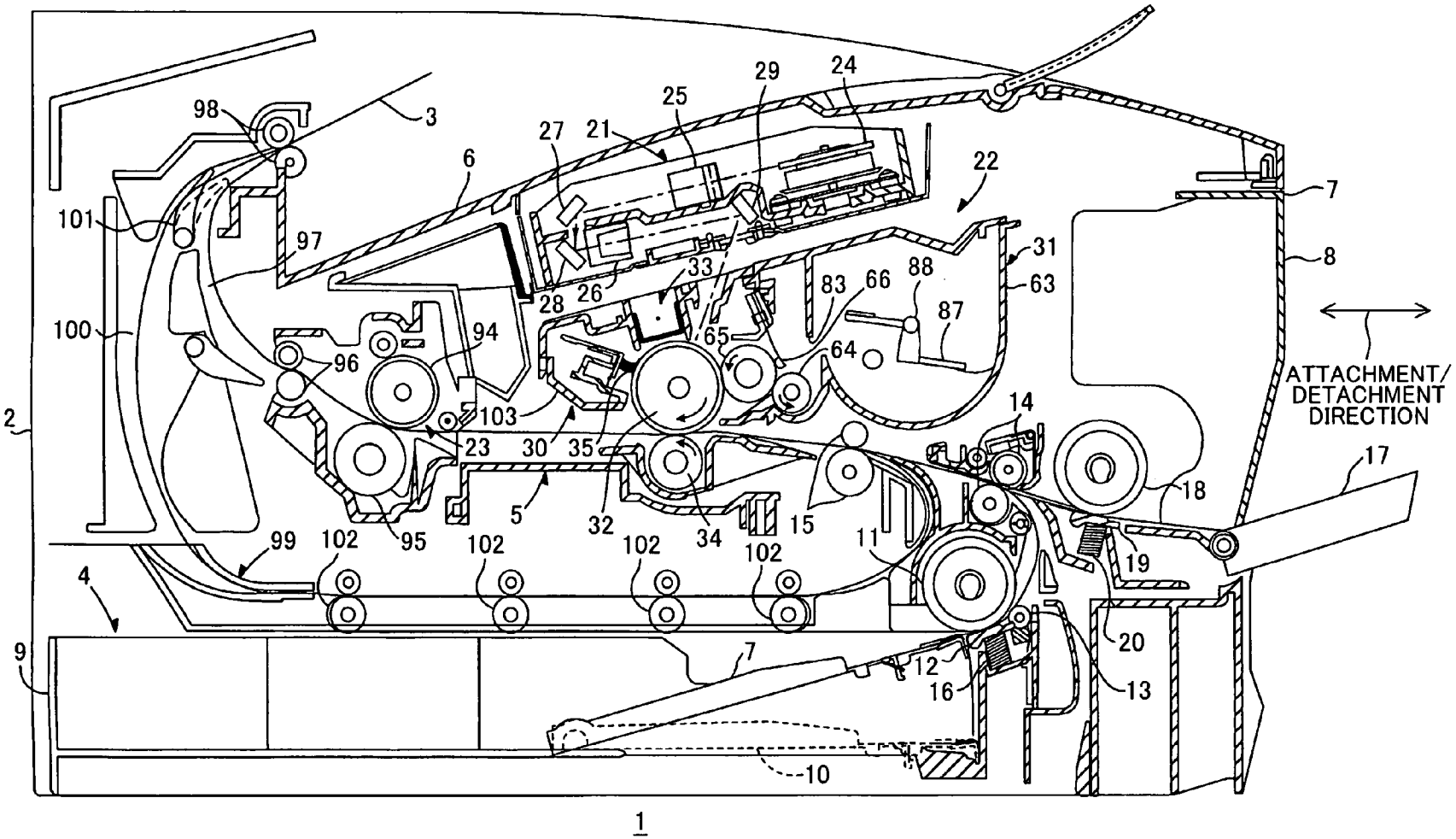
FIG. 1 is a side cross-sectional view of a laser printer according to a first embodiment of the present invention.

FIG. 1 is a side cross-sectional view showing a laser printer 1 according to a first embodiment of the present invention. In FIG. 1, the laser printer 1 has a feeder section 4 and an image forming section 5 in a body casing 2. The feeder section 4 serves to feed a sheet of paper 3. The image forming section 5 serves to form an image on the paper sheet 3.

<Structure of Body Casing 2>

A sheet discharge tray 6 is formed on the upper face of the body casing 2. The sheet discharge tray 6 is for receiving the paper sheet 3, on which an image has been formed. On one side of the sheet discharge tray 6, an operation panel having operation keys, an LED display portion, and the like is embedded. Further, an attach/detach port 7 for attaching/detaching a process cartridge 22 described later is formed on the side wall at the operation panel side in the body casing 2. A front cover 8 is provided for opening or closing the attach/detach port 7. This front cover 8 is supported by a cover shaft (not shown) inserted in a lower end portion of the front cover 8 itself. When the front cover 8 is closed about the cover shaft as a center, the attach/detach port 7 is closed by the front cover 8. When the attach/detach port 7 is opened (tilted) about the cover shaft, the attach/detach port 7 is opened. Through the opened attach/detach port 7, the process cartridge 22 can be attached to and detached from the body casing 2.

In the description below, the side in which the front cover 8 is provided is defined as the "front side" of this laser printer 1. The side opposite to the front side is defined as the "rear side" thereof. The horizontal direction perpendicular to the front and back direction is defined as the widthwise direction of the laser printer 1.

The terms "upward", "downward", "upper", "lower,", "above", "below", "beneath", "left", "right" and the like will be used throughout the description assuming that the laser printer 1 is disposed in an orientation in which it is intended to be used. In use, the laser printer 1 is disposed as shown in FIG. 1.

<Structure of Feeder Section>

The feeder section 4 has a sheet feed tray 9, a sheet pressing plate 10, a sheet feed roller 11, a sheet feed pad 12, paper dust removal rollers 13 and 14, and a pair of registration rollers 15. The sheet feed tray 9 is detachably attached to a bottom portion of the body casing 2. The sheet pressing plate 10 is provided in the sheet feed tray 9. The sheet feed roller 11 and sheet feed pad 12 are provided above an end portion in the front side of the sheet feed tray 9. The paper dust removal rollers 13 and 14 are provided in the downstream side of the sheet feed roller 11 in the conveying direction of a paper sheet 3. The registration rollers 15 are provided in the downstream side of the paper dust removal rollers 13 and 14 in the conveying direction of the paper sheet 3.

The sheet pressing plate 10 allows paper sheets 3 to be stacked thereon, and is supported to be able to pivot about an end portion thereof farther from the sheet feed roller 11. The other end portion nearer to the sheet feed roller 11 is therefore movable in the vertical direction. The sheet pressing plate 10 is urged in the vertical direction by a spring (not shown) from the back side thereof. Therefore, as the quantity of stacked paper sheets 3 increases, the sheet pressing plate 10 is pivoted downwardly about the end portion farther from the sheet feed roller 11 against the urging force of the spring. The sheet feed roller 11 and the sheet feed pad 12 are opposed to each other. The sheet feed pad 12 is pressed against the sheet feed roller 11 by a spring 16 provided on the back side of sheet feed pad 12.

The paper sheet 3 positioned at the uppermost position of the stack on the sheet pressing plate 10 is pressed against the sheet feed roller 11 by the urging force of the spring from the back side of the sheet pressing plate 10. This paper sheet 3 is held between the sheet feed roller 11 and the sheet feed pad 12 by rotation of the sheet feed roller 11, so that paper sheets 3 are fed one sheet at a time.

Further, paper dust is removed by the paper dust removal rollers 13 and 14. Thereafter, the paper sheet is conveyed by the registration rollers 15.

After registering the paper sheet 3, the pair of registration rollers 15 convey the paper sheet 3 to a transfer position (between a photosensitive drum 32 and a transfer roller 34 which will be described later, that is, the position where a toner image on the photosensitive drum 32 is transferred to the paper sheet 3) in the image forming section 5.

The feeder section 4 further has a multipurpose tray 17, a multipurpose tray side sheet feed roller 18, and a multipurpose tray side sheet feed pad 19. The multipurpose tray side sheet feed roller 18 and multipurpose tray side sheet feed pad 19 serve to feed paper sheets 3 stacked on the multipurpose tray 17. The multipurpose tray side sheet feed roller 18 and the multipurpose tray side sheet feed pad 19 are opposed to each other. The multipurpose tray side sheet feed pad 19 is pressed toward the multipurpose tray side sheet feed roller 18 by a spring 20 provided in the back side of the multipurpose tray side sheet feed pad 19.

According to the rotation of the multipurpose tray side sheet feed roller 18, the paper sheets 3 stacked on the multipurpose tray 17 are fed one sheet at a time, and held between the multipurpose tray side sheet feed roller 18 and the multipurpose tray side sheet feed pad 19.

<Structure of Image Forming Section>

The image forming section 5 has a scanner section 21, the process cartridge 22, and a fixing section 23.

<Structure of Scanner Section>

The scanner section 21 is provided at an upper portion inside the body casing 2. The scanner section 21 has a laser light emission section (not shown), a polygon mirror 24 which is driven to rotate, lenses 25 and 26, and reflection mirrors 27, 28, and 29. A laser beam is emitted from the laser light emission section based on image data, passes through or is reflected by the polygon mirror 24, lens 25, reflection mirrors 27 and 28, lens 26, and reflection mirror 29 in this order, as indicated by a chain line. The laser beam is thus radiated on the surface of the photosensitive drum 32 in the process cartridge 22 by high-speed scanning.

<Structure of Process Cartridge>

Figure 2:
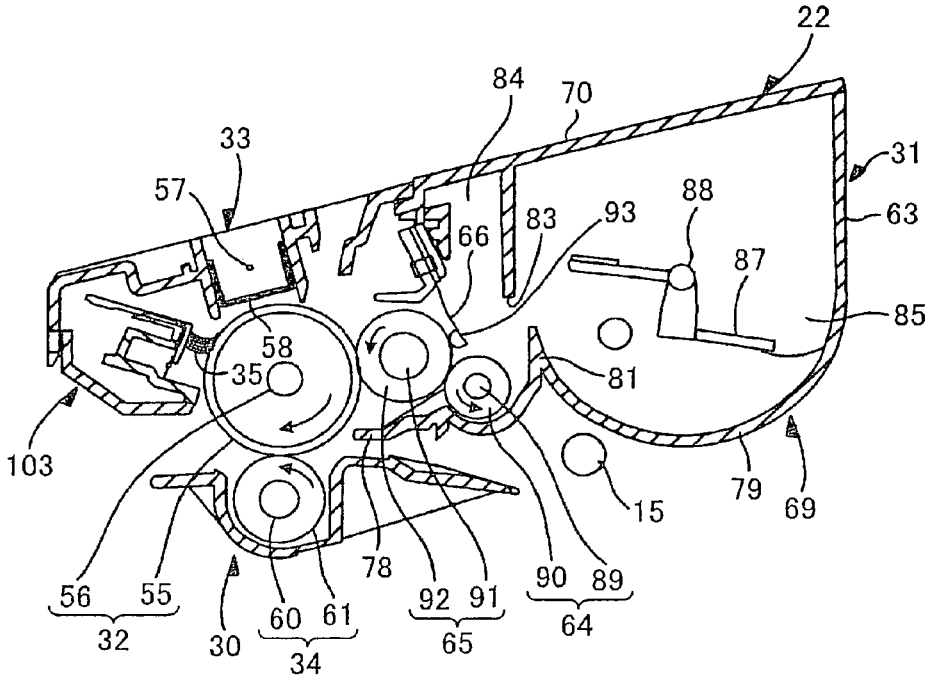
FIG. 2 is a side cross-sectional view of a process cartridge shown in FIG. 1.

FIG. 2 is a side cross-sectional view of the process cartridge 22.

The process cartridge 22 is detachably mounted in the body casing 2 at a location below the scanner section 21. The process cartridge 22 has a drum cartridge 30, and a developer cartridge 31 which is detachably attached to the drum cartridge 30.

<Structure of Drum Cartridge>

As shown in FIG. 2, the drum cartridge 30 has a cartridge frame 103, a photosensitive drum 32, a scorotron charger 33, a transfer roller 34, and a cleaning brush 35, which are provided in the cartridge frame 103.

The photosensitive drum 32 has a cylindrical drum body 55 and a metal drum shaft 56. The drum body 55 has an outermost surface layer made of photosensitive material, such as polycarbonate, that has positive charging nature. The drum shaft 56 extends along the lengthwise direction of the drum body 55 on the axis of the drum body 55. The drum shaft 56 is supported unrotatable by both side walls in the width direction of the cartridge frame 103. The drum body 55 is supported rotatable relative to the drum shaft 56. Thus, the photosensitive drum 32 is rotatable about the drum shaft 56 relative to the cartridge frame 103.

The scorotron charger 33 is provided above the photosensitive drum 32, opposed to the photosensitive drum 32, with a distance therebetween so that the scorotron charger 33 will not contact the photosensitive drum 32. The scorotron charger 33 has a wire 57 and a grid 58.

The wire 57 extends between both side walls in the width direction of the cartridge frame 103.

The grid 58 is provided in the lower side of the wire 57 to extend along the widthwise direction and is held between both side walls in the widthwise direction of the cartridge frame 103.

The transfer roller 34 is supported rotatably by both side walls in the widthwise direction of the cartridge frame 103. As shown in FIG. 2, the transfer roller 34 is opposed to and contacts the photosensitive drum 32 from the lower side of the photosensitive drum 32 in the vertical direction, thereby forming a nip between the transfer roller 34 and the photosensitive drum 32. The transfer roller 34 is constituted by covering a transfer roller shaft 60 made of metal, with a roller 61 made of conductive rubber material.

The cleaning brush 35 is provided in the rear side of the photosensitive drum 32. Bristles of the cleaning brush 35 are provided on a support plate having an elongated rectangular shape extending along the widthwise direction. The cleaning brush 35 is provided opposed to the photosensitive drum 32 in the front and back direction, such that the bristles contact the surface of the photosensitive drum 32 along the width direction.

<Structure of Developer Cartridge>

Figure 3:
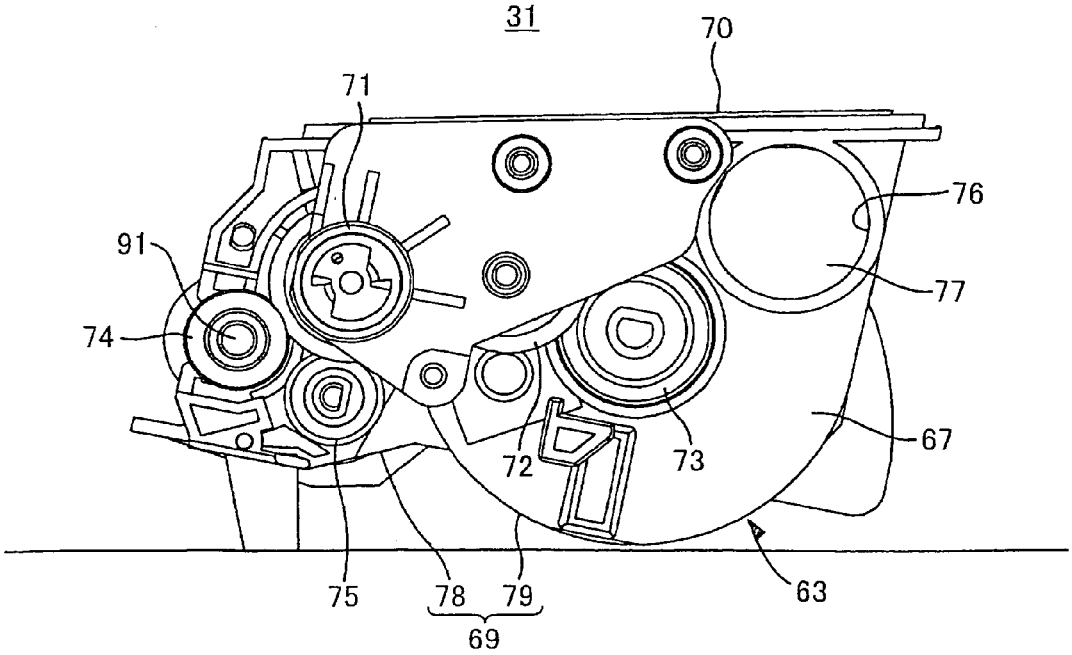
FIG. 3 is a side view of a developer cartridge shown in FIG. 1.

FIG. 3 is a left side view of the developer cartridge 31.

As shown in FIG. 2, the developer cartridge 31 is provided with a box-shaped development casing 63 open in the rear side, and a supply roller 64, a development roller 65, and a layer-thickness regulation blade 66, which are provided in the development casing 63.

The development casing 63 integrally has a pair of side walls (left-side wall and right-side wall) 67, a lower wall 69, and an upper wall 70. The pair of side walls 67 are provided opposed to each other, with a distance therebetween in the widthwise direction. The lower wall 69 and the upper wall 70 are provided in the upper and lower sides, linking the side walls 67.

As shown in FIG. 3, the left side wall 67 of the development casing 63 is provided with an intermediate gear 72, an agitator drive gear 73, a development roller drive gear 74, and a supply roller drive gear 75. The intermediate gear 72 is meshed with an input gear 71. The agitator drive gear 73 is provided in the front side of the intermediate gear 72, and is meshed with the intermediate gear 72. The development roller drive gear 74 is positioned obliquely below the input gear 71, in the rear side of the input gear 71, and is meshed with the input gear 71. The supply roller drive gear 75 is provided below the input gear 71, and is meshed with the input gear 71. Drive force from a motor (not shown) in the body casing 2 of the laser printer 1 is inputted to the input gear 71.

A filling port 76 for filling toner in a toner accommodating chamber 85 is formed in the left side wall 67 obliquely above the agitator drive gear 73 in the front side of the agitator drive gear 73. This filling port 76 is formed, at a position corresponding to the toner accommodating chamber 85, in a circular shape penetrating the side wall 67 in the thickness direction thereof. The filling port 76 is in fluid communication with the toner accommodating chamber 85. The filling port 76 is closed by a cap 77 to prevent toner in the toner accommodating chamber 85 from leaking through the filling port 76.

The lower wall 69 has a plate shape extending in the front and back direction and the widthwise direction, and integrally has a rear lower wall portion 78 and a front lower wall portion 79. As shown in FIG. 2, the rear lower wall portion 78 serves to partition a development chamber 84 described later. The front lower wall portion 79 is continuous to a front side edge of the rear lower wall portion 78, and has a substantially arc-shaped cross-section along the rotational path of an agitator 87 described later. The lower wall 69 is provided to be sandwiched and held between both side walls 67.

A lower partition portion 81 having a substantially triangular cross-sectional shape and protruding upwardly is formed along the widthwise direction, at the boundary between the rear lower wall portion 78 and the front lower wall portion 79.

The upper wall 70 has a plate shape. An upper partition plate 83 is formed along the widthwise direction on the lower face of the upper wall 70, and protrudes downwardly, opposed to the lower partition portion 81 of the lower wall 69.

Further, in the development casing 63, an inner space behind the upper partition plate 83 and the lower partition portion 81 is defined as the development chamber 84. Another inner space in front of the upper partition plate 83 and the lower partition portion 81 is defined as the toner accommodating chamber 85.

Non-magnetic, single component toner with positive charging nature is accommodated in the toner accommodating chamber 85. The toner is polymerized toner obtained by copolymerizing a styrene monomer such as styrene or an acrylic monomer such as an acrylic acid, alkyl (C1 to C4) acrylate, or alkyl (C1 to C4) methacrylate, according to a known copolymerization method such as a suspension polymerization method. This kind of polymerized toner particles are spherical and have excellent fluidity. Therefore, images can be formed with high image quality.

The toner is mixed with a coloring agent such as carbon black or wax. In order to improve fluidity, an external additive agent such as silica is added. The particle diameter of the toner is about 6 to 10 μm.

Also in the toner accommodating chamber 85, the agitator 87 is provided for stirring toner in the toner accommodating chamber 85. At the central portion of the toner accommodating chamber 85, the agitator 87 is supported by an agitator rotation shaft 88 extending in the widthwise direction.

The supply roller 64 is provided in the front lower side of the development chamber 84, and is supported rotatably between both side walls 67 of the development casing 63. The supply roller 64 has a metal supply roller shaft 89, and a sponge roller 90. The supply roller shaft 89 extends in the widthwise direction. The sponge roller 90 made of conductive foaming material covers the circumference of the supply roller shaft 89.

The development roller 65 is provided in the rear lower side in the development chamber 84. The development roller 65 and the supply roller 64 are pressed to contact each other. A rear part of the development roller 65 is partially exposed to the rear side from the development casing 63. The development roller 65 has a metal development roller shaft 91, which is covered with a rubber roller 92 made of conductive rubber material. The rubber roller 92 covers the circumference of the development roller shaft 91. The rubber roller 92 is made of conductive urethane rubber or silicone rubber containing fine carbon particles. The surface of the rubber roller 92 is covered with urethane rubber or silicone rubber containing fluorine. Shaft end portions in both sides of the development roller shaft 91 are provided protruding to the outside in the widthwise direction from both side walls 67 of the development casing 63, as shown in FIG. 3.

As shown in FIG. 2, the layer-thickness regulation blade 66 is formed of a metal plate spring. The layer-thickness regulation blade 66 has, at a tip end portion thereof, a pressing rubber member 93 having a semi-circular cross-section made of insulating silicone rubber. Further, the layer-thickness regulation blade 66 is supported by the development casing 63, above the development roller 65. A lower end portion of the layer-thickness regulation blade 66 is opposed to the rubber roller 92 of the development roller 65 from the front side. The pressing rubber member 93 is pressed to contact the surface of the rubber roller 92 by elastic force of the layer-thickness regulation blade 66.

A drive force is inputted to the input gear 71 of the developer cartridge 31. By this drive force, the agitator 87 is rotated about the agitator rotation shaft 88. Then, toner in the toner accommodating chamber 85 is stirred and emitted toward the development chamber 84 between the upper partition plate 83 and the lower partition portion 81. Then, the toner is supplied onto the development roller 65 as the supply roller 64 rotates. At this time, toner is positively charged due to friction between the sponge roller 90 of the supply roller 64 and the rubber roller 92 of the development roller 65. As the development roller 65 rotates, toner on the development roller 65 enters between the development roller 65 and the pressing rubber member 93 of the layer-thickness regulation blade 66 to become a thin layer of a uniform thickness. The layer is carried on the development roller 65.

Meanwhile, the surface of the photosensitive drum 32 is positively charged uniformly by the scorotron charger 33. Thereafter, the surface of the photosensitive drum 32 is exposed by high-speed scanning with a laser beam from the scanner section 21. An electrostatic latent image based on image data is thus formed.

Next, as the development roller 65 rotates, the positively charged toner carried on the development roller 65 comes to be opposed to and contacts the photosensitive drum 32. At this time, the toner is supplied to the electrostatic latent image formed on the photosensitive drum 32. That is, of the surface of the photosensitive drum 32 uniformly charged positively, exposed areas that have been exposed with a laser beam and have a lowered potential are supplied with the toner. Accordingly, the toner is selectively carried on the photosensitive drum 32 and the electrostatic latent image is developed into a visible toner image. As a result, a toner image is formed by a reverse development.

The photosensitive drum 32 and the transfer roller 34 are driven to rotate, holding a paper sheet 3 sandwiched therebetween. The paper sheet 3 is thus conveyed between the photosensitive drum 32 and the transfer roller 34. The toner image carried on the surface of the photosensitive drum 32 is thereby transferred to the paper sheet 3.

<Structure of Fixing Section>

As shown in FIG. 1, the fixing section 23 is provided at the rear side of the process cartridge 22 and on the downstream side on the conveying direction of the paper sheet 3. The fixing section 23 has a heating roller 94, a press roller 95 which presses the heating roller 94, and a pair of conveyer rollers 96. The press roller 95 is opposed to the heating roller 94. The pair of conveyer rollers 96 are provided on the downstream side of the heating roller 94 and the press roller 95 in the conveying direction of the paper sheet 3.

The heating roller 94 is made of metal, and a halogen lamp for heating therein is installed in the heating roller 94. In the fixing section 23, the toner image transferred to the paper sheet 3 by the process cartridge 22 is thermally fixed while the paper sheet 3 passes between the heating roller 94 and the press roller 95. Thereafter, the paper sheet 3 is conveyed to a sheet discharge path 97 by the conveyer rollers 96. The paper sheet 3 is conveyed to sheet discharge rollers 98, and is discharged onto the sheet discharge tray 6 by the sheet discharge rollers 98.

In this laser printer 1, residual toner remaining on the surface of the photosensitive drum 32 after an image is transferred to the paper sheet 3 by the transfer roller 34 is collected by the development roller 65 through a so-called cleanerless method. Because the toner remaining on the photosensitive drum 32 is collected by this cleanerless method, neither a toner cleaner device nor a storage portion of waste toner are necessary. The structure of the apparatus 1 can be simplified.

<Structure of Reverse Conveyer Section>

The laser printer 1 is provided with a reverse conveyer section 99 to form images on both of a pair of opposite surfaces of a paper sheet 3. This reverse conveyer section 99 has the sheet discharge rollers 98, a reverse conveying path 100, a flapper 101, and plural reverse conveyer rollers 102.

The sheet discharge rollers 98 are constituted by a pair of rollers and can be switched between regular rotation and reverse rotation. In order to discharge a paper sheet 3 onto the sheet discharge tray 6, the sheet discharge rollers 98 rotate in the regular direction. Otherwise, in order to reverse the paper sheet 3 upside down, the sheet discharge rollers 98 rotate in the reverse direction.

The reverse conveying path 100 is arranged along the vertical direction so that the paper sheet 3 can be conveyed from the sheet discharge rollers 98 to the plural reverse conveyer rollers 102 that are located below the image forming position. An end portion of the path on the upstream side is positioned near the sheet discharge rollers 98. Another end thereof on the downstream side is positioned near the reverse conveyer rollers 102.

The flapper 101 is provided facing a branch portion between the sheet discharge path 97 and the reverse conveying path 100. The flapper 101 is pivotable. By excitation or non-excitation of a solenoid not shown, the flapper 101 switches the conveying direction of the paper sheet 3 that is reversed by the sheet discharge rollers 98 from the direction toward the sheet discharge path 97 to the direction toward the reverse conveying path 100.

Plural reverse conveyer rollers 102 are arranged in the horizontal direction, above the sheet feed tray 9. The reverse conveyer roller 102 on the most upstream side is positioned near the rear end portion of the reverse conveying path 100. The reverse conveyer rollers 102 on the most downstream side are positioned below the registration rollers 15.

In order to form images on two sides of the paper sheet 3, the reverse conveyer section 99 is operated as follows. That is, a paper sheet 3 having a face on which an image has been formed is conveyed from the sheet discharge path 97 to the sheet discharge rollers 98 by the conveyer rollers 96. Then, the sheet discharge rollers 98 regularly rotate with the paper sheet 3 sandwiched therebetween, and convey the paper sheet 3 once in a direction toward the outside (the side of the sheet discharge tray 6). When most of the paper sheet 3 is fed to the outside and the rear end of the paper sheet 3 is sandwiched between the sheet discharge rollers 98, the regular rotation stops. Subsequently, the sheet discharge rollers 98 begin rotating in the reverse directions, to switch the conveying direction such that the paper sheet 3 is conveyed to the reverse conveying path 100. The paper sheet 3 is conveyed along the reverse conveying path 100 with the leading and trailing edges of the paper sheet 3 reversed. After conveyance of the paper sheet 3 is completed, the flapper 101 is switched to an original state, i.e., a state in which the paper sheet 3 fed from the conveyer rollers 96 will be sent to the sheet discharge rollers 98.

The paper sheet 3 is conveyed along the reverse conveying path 100 in the opposite direction to the reverse conveyer rollers 102. From the reverse conveyer rollers 102, the paper sheet 3 is further reversed toward the upward direction, and sent to the registration rollers 15. In the reversed condition, the paper sheet 3 is registered again by the registration rollers 15. Thereafter, the paper sheet 3 is fed to the image forming position. Images are thus formed on both surfaces of the paper sheet 3.

Figure 4A:
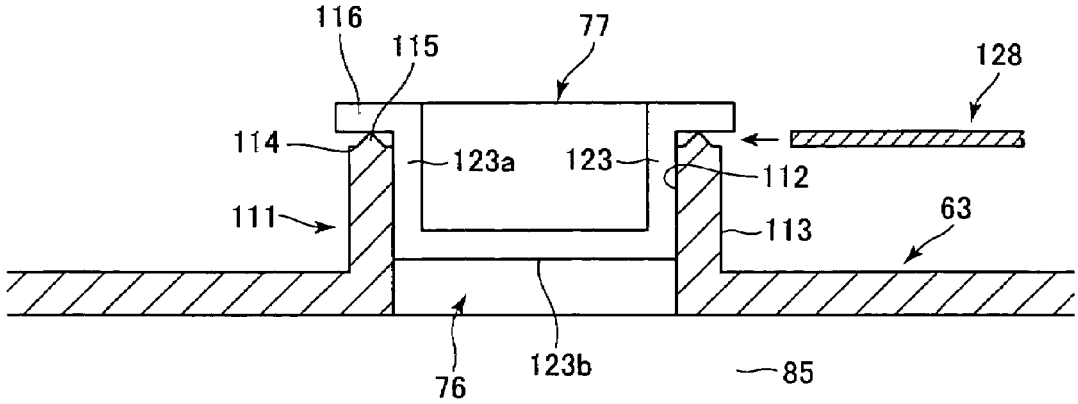
FIG. 4A is a cross-sectional view showing how a cap closes a filling port of the developer cartridge shown in FIG. 3 during an initial use according to the first embodiment.
Figure 4B:
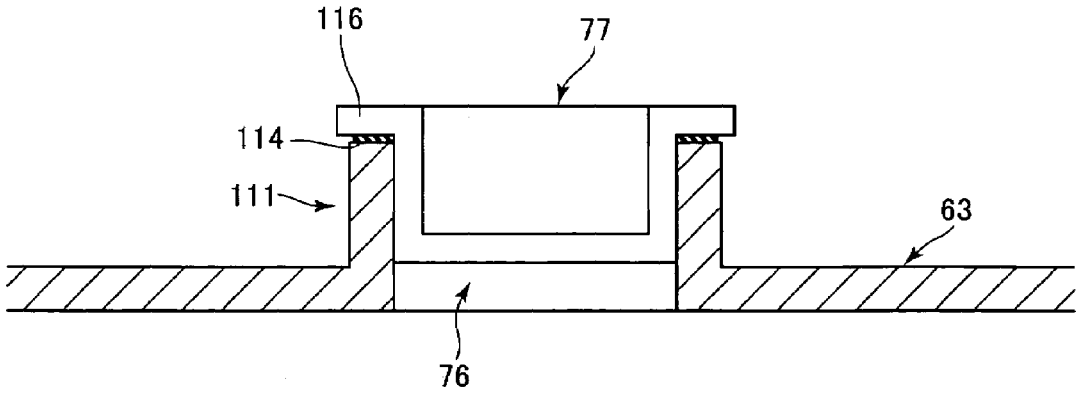
FIG. 4B is a cross-sectional view showing how the cap closes the filling port after toner is refilled in the developer cartridge to reuse the developer cartridge according to the first embodiment.

Next will be described with reference to FIG. 4A and FIG. 4B how the filling port 76 is closed by the cap 77. FIG. 4A shows how the filling port 76 is closed by the cap 77 when the developer cartridge 31 is initially used. FIG. 4B shows how the filling port 76 is closed by the cap 77 when the developer cartridge 31 is reused, that is, after toner is consumed up through the initial use of the developer cartridge 31 and toner is refilled in the developer cartridge 31.

As shown in FIG. 4A, the developer cartridge 31 has a filling-port cylindrical portion 111. The filling-port cylindrical portion 111 protrudes from the side wall 67 to the outside of the casing 63. The filling-port cylindrical portion 111 protrudes from the peripheral edge of the circular filling port 76. The filling-port cylindrical portion 111 has a hollow circular cylindrical shape. In other words, the filling-port cylindrical portion 111 has a circular cross-section perpendicular to its longitudinal axis.

The filling-port cylindrical portion 111 has an inner peripheral surface 112, an outer peripheral surface 113, and a tip end surface 114. The tip end surface 114 is positioned between the surfaces 112 and 113. A protruding portion 115 is formed on the tip end surface 114.

The cap 77 is inserted in the filling-port cylindrical portion 111 to close the filling port 76. The cap 77 integrally has an insertion portion 123 and a flange portion 116. The insertion portion 123 is of a bottomed, hollow circular cylindrical shape. In other words, the insertion portion 123 has a cylindrical portion 123*a* and a bottom portion 123*b*. The cylindrical portion 123*a* is of a hollow circular cylindrical shape, and the bottom portion 123*b* is of a circular shape. The flange portion 116 is of a circular ring shape. The bottom portion 123*b* extends radially inwardly from one axial end of the cylindrical portion 123*a* to close the one axial end of the cylindrical portion 123*a*. The flange portion 116 extends radially outwardly from the other axial end of the cylindrical portion 123*a*, while maintaining the other axial end of the cylindrical portion 123*a* to be opened. The cylindrical portion 123*a* contacts the inner peripheral surface 112, and the flange portion 116 contacts the protruding portion 115 of the tip end surface 114.

After filling toner in a new developer cartridge 31, the insertion portion 123 of the cap 77 is pressingly inserted in the filling-port cylindrical portion 111 as shown in FIG. 4A. Accordingly, the outer peripheral surface of the cylindrical portion 123*a* is hermetically or air-tightly fitted to the inner peripheral surface 112 of the filling-port cylindrical portion 111 so that no air or no fluid can leak between the cylindrical portion 123*a* and the filling-port cylindrical portion 111. Therefore, toner accommodated in the toner accommodating chamber 85 is prevented from leaking through the filling port 76.

When the cap 77 is thus pressingly fitted in the filling-port cylindrical portion 111, the tip end surface 114 of the filling-port cylindrical portion 111 and the flange portion 116 of the cap 77 contact each other with the protruding portion 115 being interposed therebetween.

Meanwhile, the amount of toner contained in the toner accommodating chamber 85 decreases as the laser printer 1 prints images on paper sheets 3. When the toner in the toner accommodating chamber 85 is consumed up, the developer cartridge 31 is detached from the body casing 2 and is replaced with another developer cartridge 31 filled with toner. Empty developer cartridges 31 should desirably be collected by the manufacturer of the laser printer 1 and recycled by refilling toner in the toner accommodating chambers 85 for resource saving.

It is noted that a small gap approximately equivalent to the height of the protruding portion 115 exists between the tip end surface 114 and the flange portion 116 of the cap 77. In other words, the tip end surface 114 of the filling-port cylindrical portion 111 and the flange portion 116 of the cap 77 are not in tight contact with each other. Accordingly, by inserting a tip end of a detachment tool 128 into the gap as shown in FIG. 4A, the cap 77 can be detached from the filling-port cylindrical portion 111, without damaging the tip end surface 114, to open the filling port 76. Then, toner is refilled through the filling port 76 into the toner accommodating chamber 85.

Thereafter, the insertion portion 123 of the cap 77 is again pressingly fitted in the filling-port cylindrical portion 111. Then, ultrasonic welding is performed on the protruding portion 115 from an upper surface of the flange portion 115 in FIG. 4B that is opposite to the surface of the flange portion 116 that contacts the protruding portion 115. Thus, the protruding portion 115 and the surface of the flange portion 116 that contacts the protruding portion 115 are ultrasonically welded.

It is noted that ultrasonic vibrations are more concentrated on a protruding portion, compared with another case where ultrasonic welding is executed between surfaces. Accordingly, welding can be achieved efficiently according to the present embodiment.

As shown in FIG. 4B, the protruding portion 115 is melted, and the flange portion 116 of the cap 77 and the tip end surface 114 of the filling-port cylindrical portion 111 are firmly fixed to each other. It is noted that there will possibly be the case that the tip end surface 114 happens to be damaged when the cap 77 is detached from the filling-port cylindrical portion 111. Even in such a case, after the cap 77 is welded on the filling-port cylindrical portion 111 as shown in FIG. 4B, toner can be prevented from leaking from the filling-port cylindrical portion 111.

<First Modification>

Figure 5A:
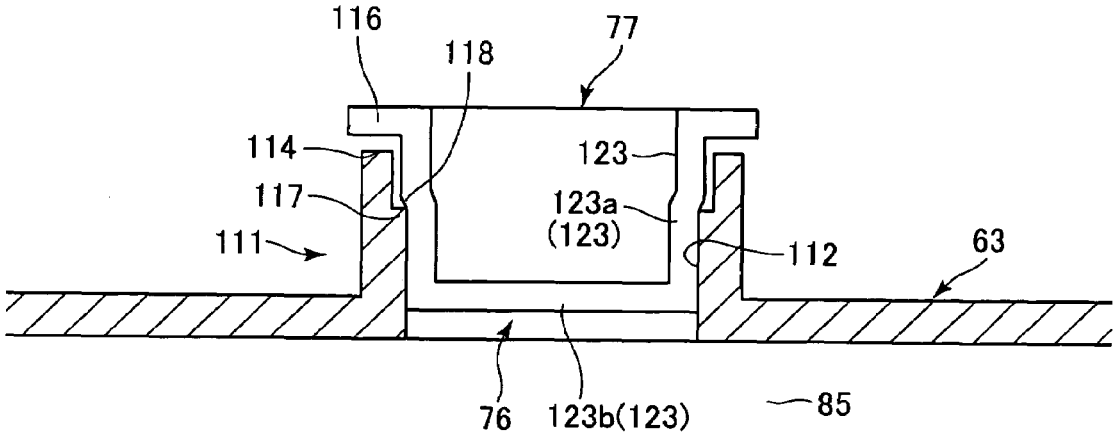
FIG. 5A is a cross-sectional view showing how a cap closes the filling port of the developer cartridge during an initial use according to a first modification of the first embodiment.
Figure 5B:
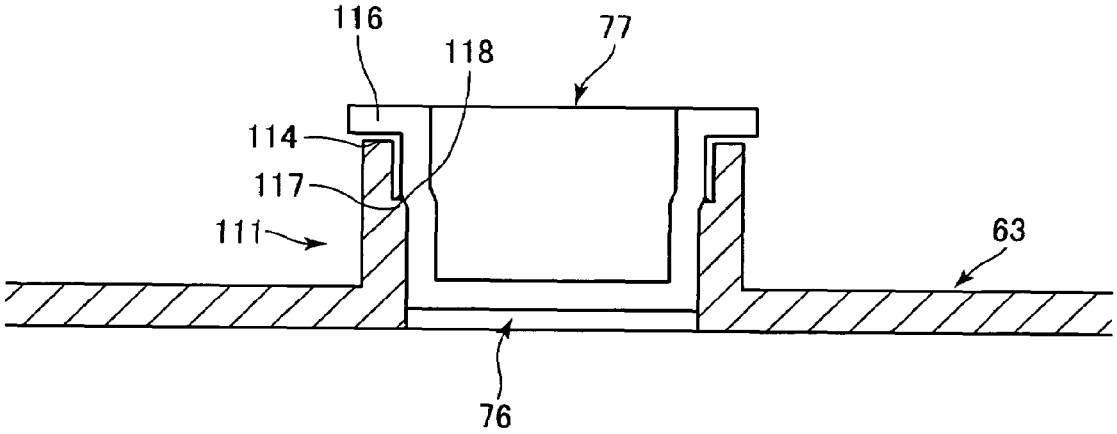
FIG. 5B is a cross-sectional view showing how the cap closes the filling port after toner is refilled in the developer cartridge to reuse the developer cartridge according to the first modification of the first embodiment.

The filling-port cylindrical portion 111 and the cap 77 may be modified as shown in FIG. 5A and FIG. 5B.

That is, the protruding portion 115 shown in FIG. 4A is not formed on the tip end surface 114, but a stepped portion 117 is formed on the tip end surface 114 as shown in FIG. 5A. The stepped portion 117 is continuous with the inner peripheral surface 112. The cap 77 is formed with a slope surface 118. The slope surface 118 spreads or widens radially outwardly in a direction from the bottom 123*b* toward the flange portion 116. The cap 77 contacts the stepped portion 117 at its slope surface 118.

After filling toner in a new developer cartridge 31, the insertion portion 123 of the cap 77 is pressingly inserted in the filling-port cylindrical portion 111 as shown in FIG. 5A. As a result, the outer peripheral surface of the cylindrical portion 123*a* is air-tightly fitted against the inner peripheral surface 112. Toner contained in the toner accommodating chamber 85 is prevented from leaking through the filling-port cylindrical portion 111.

When toner contained in the toner accommodating chamber 85 is consumed up, the developer cartridge 31 is replaced with another developer cartridge 31 filled with toner. The empty developer cartridge 31 is collected by the manufacturer and recycled.

It is noted that the cap 77 has the slope surface 118. Accordingly, in the state in which the cap 77 is pressingly fitted in the filling-port cylindrical portion 111, a small gap exists between the flange portion 116 and the tip end surface 114. The flange portion 116 and the tip end surface 114 are not in firm contact with each other. Accordingly, by inserting the tip end of the detachment tool into this gap, the cap 77 can be detached without damaging the tip end surface 114, and toner can be refilled in the toner accommodating chamber 85 for recycle use.

After refilling toner in the toner accommodating chamber 85, the insertion portion 123 of the cap 77 is again pressingly inserted in the filling-port cylindrical portion 111. Then, ultrasonic welding is performed on the stepped portion 117 from the slope surface 118 side. The ultrasonic vibrations are concentrated on the stepped portion 117 where the filling-port cylindrical portion 111 contacts the slope surface 118.

Accordingly, welding can be achieved efficiently. That is, as shown in FIG. 5B, the stepped portion 117 is melted, and the slope surface 118 of the cap 77 and the stepped portion 117 of the tip end surface 114 are firmly fixed to each other. Even if the tip end surface 114 has happened to be damaged when the cap 77 is detached from the state of FIG. 5A, the cap 77 attached in the state of FIG. 5B can prevent toner from leaking through the filling-port cylindrical portion 111.

<Second Modification>

Figure 6A:
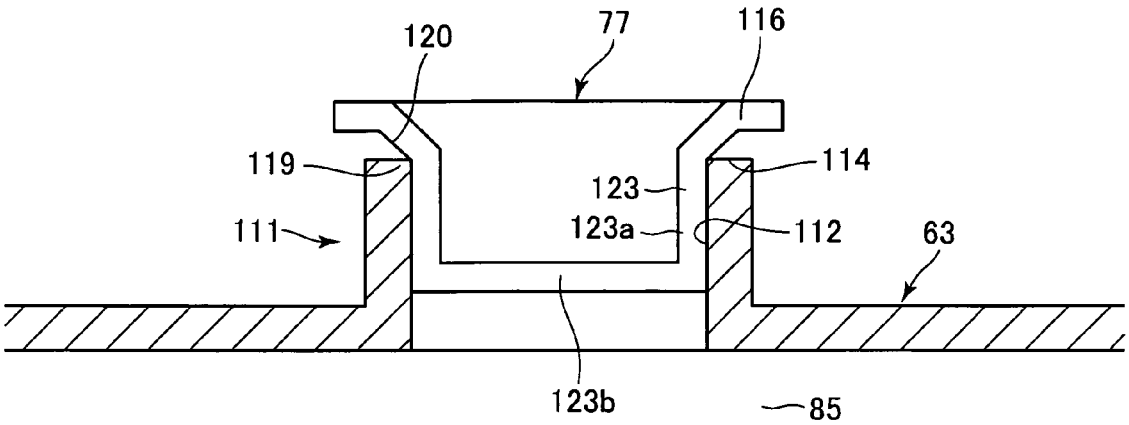
FIG. 6A is a cross-sectional view showing how a cap closes the filling port of the developer cartridge during an initial use according to a second modification of the first embodiment.
Figure 6B:
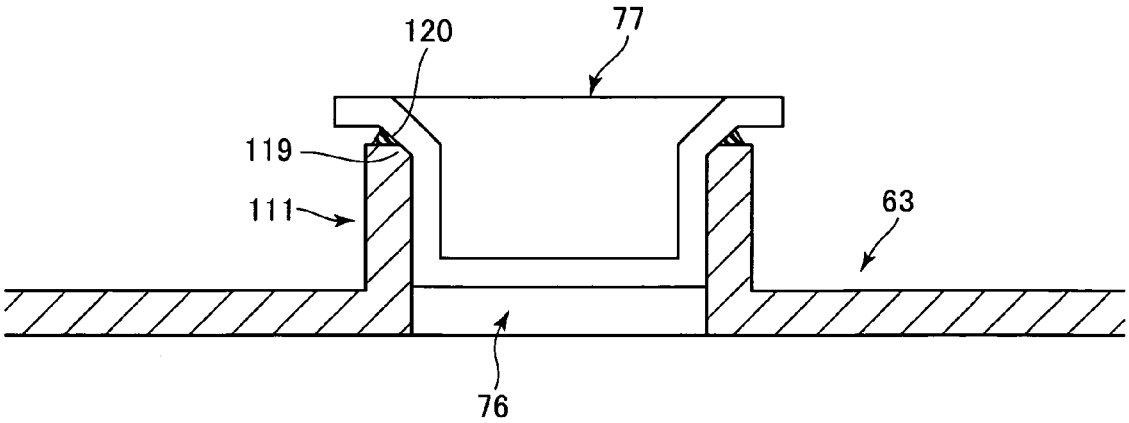
FIG. 6B is a cross-sectional view showing how the cap closes the filling port after toner is refilled in the developer cartridge to reuse the developer cartridge according to the second modification of the first embodiment.

The filling-port cylindrical portion 111 and the cap 77 may be modified as shown in FIG. 6A and FIG. 6B.

In this modification, the protruding portion 115 shown in FIG. 4A is not formed on the tip end surface 114 as shown in FIG. 5A. A slope surface 120 is formed on the cap 77 at its position where the cap 77 contacts an inner peripheral edge portion 119 of the filling-port cylindrical portion 111 that is defined between the tip end surface 114 and the inner peripheral surface 112. The slope surface 120 spreads or widens radially outwardly in a direction from the bottom 123*b* toward the flange portion 116.

After filling toner in a new developer cartridge 31, the insertion portion 123 of the cap 77 is pressingly inserted in the filling-port cylindrical portion 111 as shown in FIG. 6A. As a result, the outer peripheral surface of the cylindrical portion 123*a* is air-tightly fitted against the inner peripheral surface 112. Toner contained in the toner accommodating chamber 85 is prevented from leaking through the filling-port cylindrical portion 111.

When toner contained in the toner accommodating chamber 85 is consumed up, the developer cartridge 31 is replaced with another developer cartridge 31 filled with toner. The empty developer cartridge 31 is collected by the manufacturer and recycled.

It is noted that the cap 77 has the slope surface 120. Accordingly, in the state in which the cap 77 is pressingly fitted in the filling-port cylindrical portion 111, a small gap exists between the flange portion 116 and the tip end surface 114. The flange portion 116 and the tip end surface 114 are not in firm contact with each other. Accordingly, by inserting the tip end of the detachment tool into this gap, the cap 77 can be detached without damaging the tip end surface 114, and toner can be refilled in the toner accommodating chamber 85 for recycle use.

After refilling toner in the toner accommodating chamber 85, the insertion portion 123 of the cap 77 is again pressingly inserted in the filling-port cylindrical portion 111. Then, ultrasonic welding is performed on the inner peripheral edge portion 119 from the slope surface 120 side. The ultrasonic vibrations are concentrated on the inner peripheral edge portion 119 where the filling-port cylindrical portion 111 contacts the slope surface 120. Accordingly, welding can be achieved efficiently. That is, as shown in FIG. 6B, the inner peripheral edge portion 119 is melted and the slope surface 120 of the cap 77 and the inner peripheral edge portion 119 of the tip end surface 114 are firmly fixed to each other. Even if the tip end surface 114 has happened to be damaged when the cap 77 is detached from the state of FIG. 6A, the cap 77 attached in the state of FIG. 6B can prevent toner from leaking through the filling-port cylindrical portion 111.

<Third Modification>

Figure 7A:
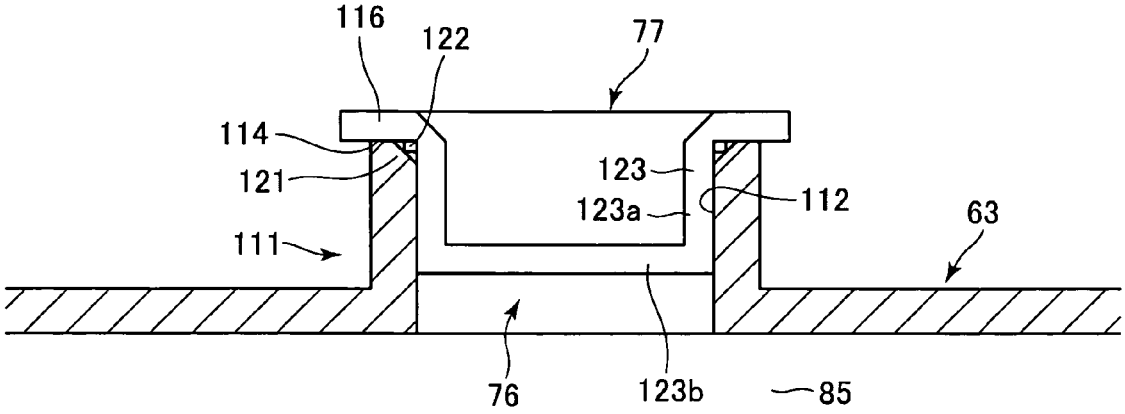
FIG. 7A is a cross-sectional view showing how a cap closes the filling port of the developer cartridge during an initial use according to a third modification of the first embodiment.
Figure 7B:
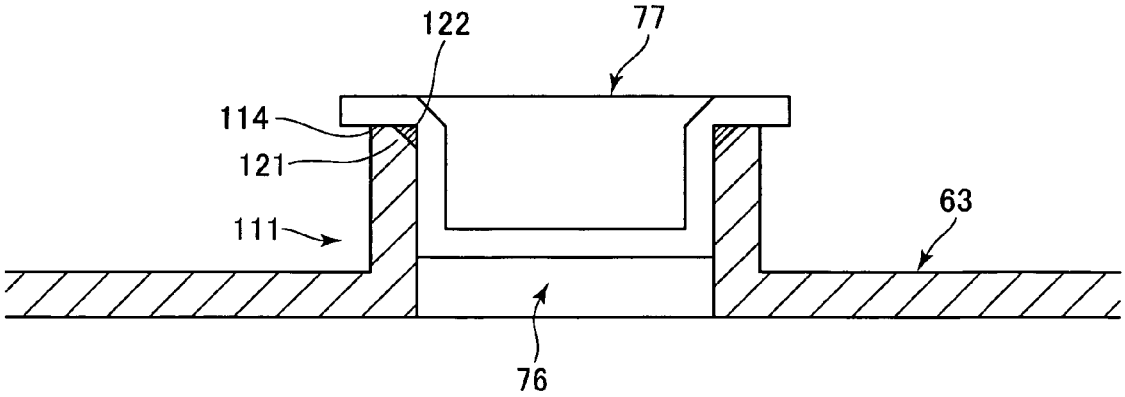
FIG. 7B is a cross-sectional view showing how the cap closes the filling port after toner is refilled in the developer cartridge to reuse the developer cartridge according to the third modification of the first embodiment.

The filling-port cylindrical portion 111 and the cap 77 may be modified as shown in FIG. 7A and FIG. 7B.

In this modification, the cap 77 is formed with a protruding portion 122 as shown in FIG. 7A. The protruding portion 122 is located on the outer circumferential surface of the cap 77, at a position between the flange portion 116 and the cylindrical portion 123*a*. Instead of the protruding portion 115 shown in FIG. 4A, a slope surface 121 is formed on the tip end surface 114 of the filling-port cylindrical portion 111 at a location where the tip end surface 114 contacts the protruding portion 122.

After filling toner in a new developer cartridge 31, the insertion portion 123 of the cap 77 is pressingly inserted in the filling-port cylindrical portion 111 as shown in FIG. 7A. As a result, the outer peripheral surface of the cylindrical portion 123*a* is air-tightly fitted against the inner peripheral surface 112. Toner contained in the toner accommodating chamber 85 is prevented from leaking through the filling-port cylindrical portion 111.

When toner contained in the toner accommodating chamber 85 is consumed up, the developer cartridge 31 is replaced with another developer cartridge filled 31 with toner. The empty developer cartridge 31 is collected by the manufacturer and recycled.

It is noted that the protruding portion 122 is not in firm contact with the slope surface 121. In addition, the contact surface area between the tip end surface 114 and the flange portion 116 is small. Therefore, the cap 77 can be easily detached from the tip end surface 114, and toner can be refilled in the toner accommodating chamber 85 for recycle use.

After refilling toner in the toner accommodating chamber 85, the insertion portion 123 of the cap 77 is again pressingly inserted in the filling-port cylindrical portion 111. Then, ultrasonic welding is performed on the protruding portion 122. The ultrasonic vibrations are concentrated on the protruding portion 122. Accordingly, welding can be achieved efficiently. That is, as shown in FIG. 7B, the protruding portion 122 is melted and the cap 77 is firmly fixed to the slope surface 121. Even if the tip end surface 114 has happened to be damaged when the cap 77 is detached from the state of FIG. 7A, the cap 77 in the state of FIG. 7B can prevent toner from leaking through the filling-port cylindrical portion 111.

<Fourth Modification>

Figure 8A:
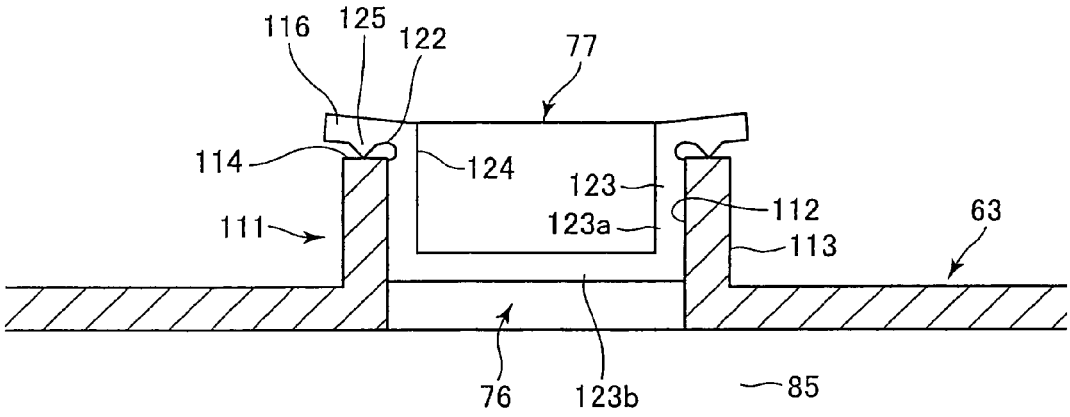
FIG. 8A is a cross-sectional view showing how a cap closes the filling port of the developer cartridge during an initial use according to a fourth modification of the first embodiment.
Figure 8B:
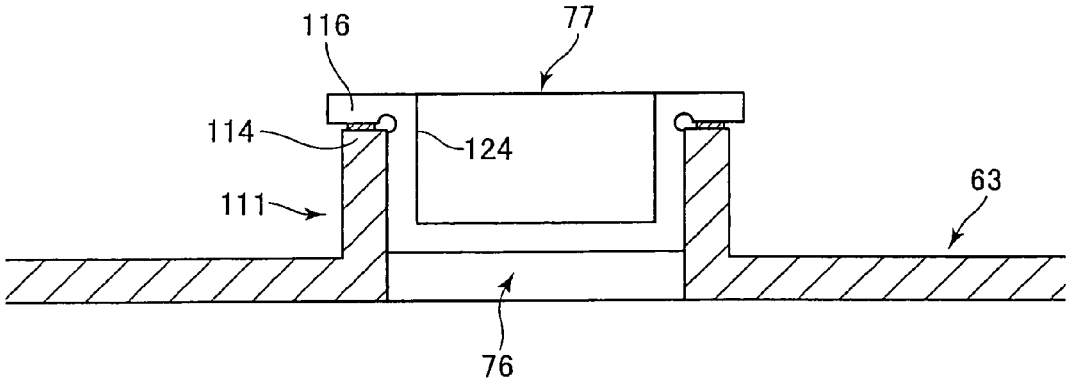
FIG. 8B is a cross-sectional view showing how the cap closes the filling port after toner is refilled in the developer cartridge to reuse the developer cartridge according to the fourth modification of the first embodiment.

The filling-port cylindrical portion 111 and the cap 77 may be modified as shown in FIG. 8A and FIG. 8B.

In this modification, as shown in FIG. 8A, the protruding portion 115 is not formed on the tip end surface 114. The cap 77 is formed with a thin portion 124 on the outer circumferential surface thereof, at a position between the flange portion 116 and the cylindrical portion 123*a*. The thin portion 124 is thinner than the other remaining portion of the cap 77. In addition, a protruding portion 125 is formed on one side of the flange portion 116 that confronts the tip end surface 114.

After filling toner in a new developer cartridge 31, the insertion portion 123 of the cap 77 is pressingly inserted in the filling-port cylindrical portion 111 as shown in FIG. 8A. As a result, the outer peripheral surface of the cylindrical portion 123*a* is air-tightly fitted against the inner peripheral surface 112. Toner contained in the toner accommodating chamber 85 is prevented from leaking through the filling-port cylindrical portion 111.

When toner contained in the toner accommodating chamber 85 is consumed up, the developer cartridge 31 is replaced with another developer cartridge 31 filled with toner. The empty developer cartridge 31 is collected by the manufacturer and recycled.

It is noted that the cap 77 is pressingly fitted in the filling-port cylindrical portion 111, with the tip end surface 114 and the flange portion 116 contacting each other through the protruding portion 125. Therefore, a small gap substantially equivalent to the height of the protruding portion 125 exists between the tip end surface 114 and the flange portion 116. Accordingly, by inserting the tip end of the detachment tool into this gap, the cap 77 can be detached without damaging the tip end surface 114, and toner can be refilled in the toner accommodating chamber 85 for recycle use.

After refilling toner in the toner accommodating chamber 85, the insertion portion 123 of the cap 77 is again pressingly inserted in the filling-port cylindrical portion 111. Thereafter, ultrasonic welding is performed on the protruding portion 125 from the flange portion 116 side. Accordingly, as shown in FIG. 8B, the protruding portion 125 is melted and the flange portion 116 of the cap 77 is firmly fixed to the tip end surface 114 of the filling-port side cylindrical portion 111. Even if the tip end surface 114 has happened to be damaged when the cap 77 is detached from the state of FIG. 8A, the cap 77 in the state of FIG. 8B can prevent toner from leaking through the filling-port cylindrical portion 111.

Also in this embodiment, the thin portion 124 is formed in the cap 77. Therefore, a small space exists between the tip end surface 114 and the flange portion 116. This space serves as a cushion when ultrasonic welding is effected while applying a pressure from the upper face of the flange portion 116 in FIG. 8B that is opposite to the surface of the flange portion 116 that contacts the tip end surface 114. In other words, this space prevents the cap 77 that is once pressed in and fixed in the filling-port cylindrical portion 111 from being further pressed into the filling-port cylindrical portion 111. The state in which the cap 77 is pressed in the filling-port cylindrical portion 111 before ultrasonic welding can be maintained even after the ultrasonic welding.

In the above description, the protruding portion 125 is formed on the flange portion 116 of the cap 77. However, the protruding portion may alternatively be formed on the tip end surface 114 of the filling-port cylindrical portion <Fifth Modification>

Figure 9A:
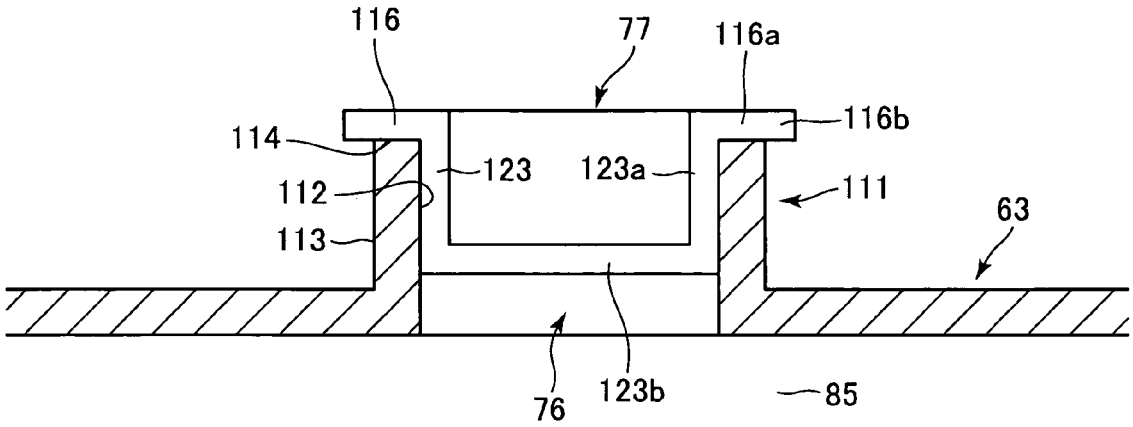
FIG. 9A is a cross-sectional view showing how a cap closes the filling port of the developer cartridge during an initial use according to a fifth modification of the first embodiment.
Figure 9B:
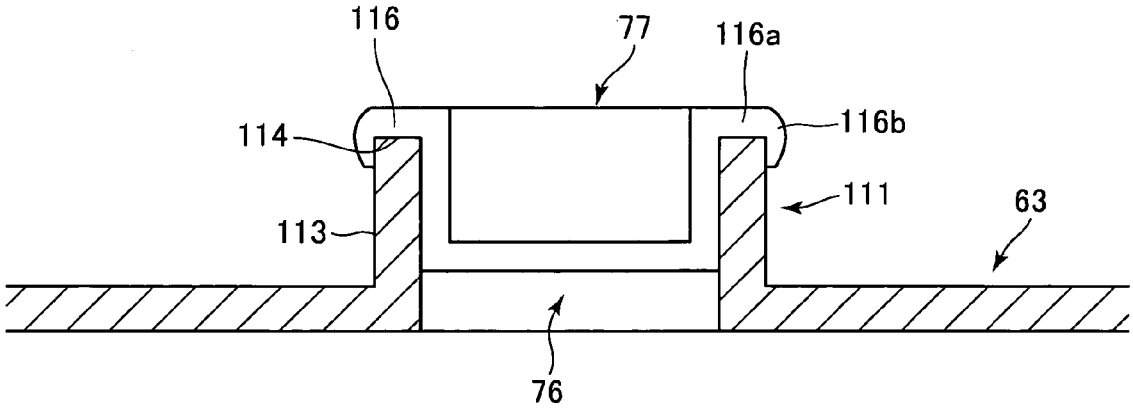
FIG. 9B is a cross-sectional view showing how the cap closes the filling port after toner is refilled in the developer cartridge to reuse the developer cartridge according to the fifth modification of the first embodiment.

The filling-port cylindrical portion 111 and the cap 77 may be modified as shown in FIG. 9A and FIG. 9B.

In this modification, as shown in FIG. 9A, the protruding portion 115 is not formed on the tip end surface 114. The flange portion 116 of the cap 77 contacts the tip end surface 114. The outer diameter of the flange portion 116 of the cap 77 is greater than the outer diameter of the filling-port cylindrical portion 111. Accordingly, the flange portion 116 extends radially outwardly from an inner circumferential edge of the tip end surface 114, at which the inner peripheral surface 112 is connected to the tip end surface 114, toward an outer circumferential edge of the tip end surface 114, at which the outer peripheral surface 113 is connected to the tip end surface 114, and extends further radially outwardly from the outer circumferential edge of the tip end surface 114. In other words, the flange portion 116 has: a radially-inner portion 116*a* that is in contact with the tip end surface 114; and a radially-outwardly extending portion 116*b* that is on the radially outer side of the filling-port cylindrical portion 111 and that is out of contact with the tip end surface 114.

After filling toner in a new developer cartridge 31, the insertion portion 123 of the cap 77 is pressingly inserted in the filling-port cylindrical portion 111 as shown in FIG. 9A. As a result, the outer peripheral surface of the cylindrical portion 123*a* is air-tightly fitted against the inner peripheral surface 112. Toner contained in the toner accommodating chamber 85 is prevented from leaking through the filling-port cylindrical portion 111.

When toner contained in the toner accommodating chamber 85 is consumed up, the developer cartridge 31 is replaced with another developer cartridge 31 filled with toner. The empty developer cartridge 31 is collected by the manufacturer and recycled. The cap 77 can be easily detached by picking up the radially-outwardly extending portion 116*b* of the cap 77, and toner can be refilled in the toner accommodating chamber 85 for recycle use.

After refilling toner in the toner accommodating chamber 85, the insertion portion 123 of the cap 77 is again pressingly inserted in the filling-port cylindrical portion 111. Thereafter, ultrasonic welding is effected on the radially-outwardly extending portion 116*b* of the flange portion 116. As a result, the radially-outwardly extending portion 116*b* is melted, as shown in FIG. 9B, and fixed to a tip end part of the outer peripheral surface 113 of the filling-port cylindrical portion 111. Even if the tip end surface 114 has happened to be damaged when the cap 77 is detached from the state of FIG. 9A, the cap 77 in the state of FIG. 9B can prevent toner from leaking through the filling-port cylindrical portion 111.

In the present modification, no protruding portion is formed at the contact portion between the tip end surface 114 and the cap 77. However, a protruding portion may be formed on at least one of the tip end surface 114 and the cap 77 at the contact portion between the tip end surface 114 and the cap 77. The protruding portion protrudes toward the other one of the end surface 114 and the cap 77. In this case, the cap 77 can be detached more easily when refilling toner for recycle use.

After refilling toner and pressingly inserting the cap 77 into the filling-port cylindrical portion 111, at the contact portion between the tip end surface 114 of the filling-port cylindrical portion 111 and the cap 77, ultrasonic welding is effected on the protruding portion. As a result, the filling-port cylindrical portion 111 and the cap 77 are firmly fixed to each other, so that leakage of toner through the filling-port cylindrical portion 111 can be prevented. Thus, the cap 77 can be easily detached at the time of recycling. After refilling toner for recycle use, the cap 77 and the filling-port cylindrical portion 111 can be firmly fixed to each other. Therefore, leakage of toner through the filling-port cylindrical portion 111 can be reliably prevented.

<Sixth Modification>

Figure 10A:
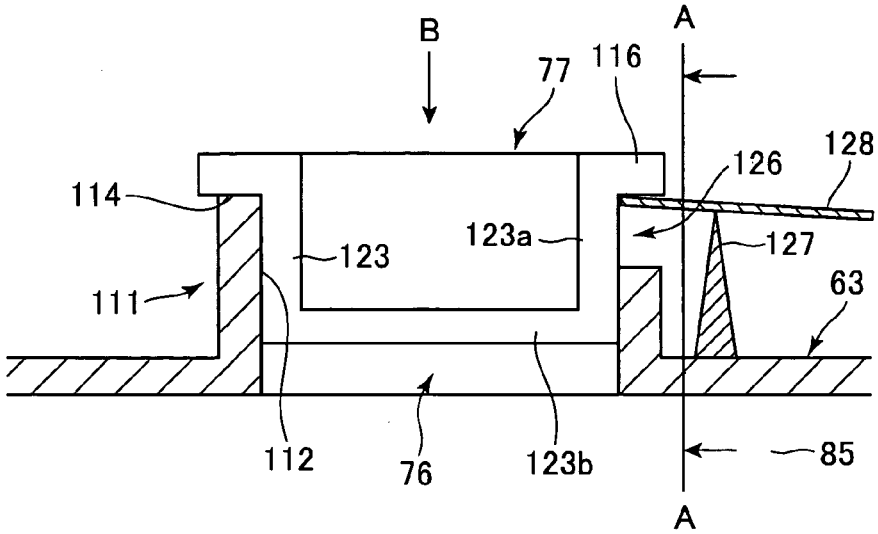
FIG. 10A is a cross-sectional view showing how a cap closes the filling port of the developer cartridge during an initial use according to a sixth modification of the first embodiment.
Figure 10B:
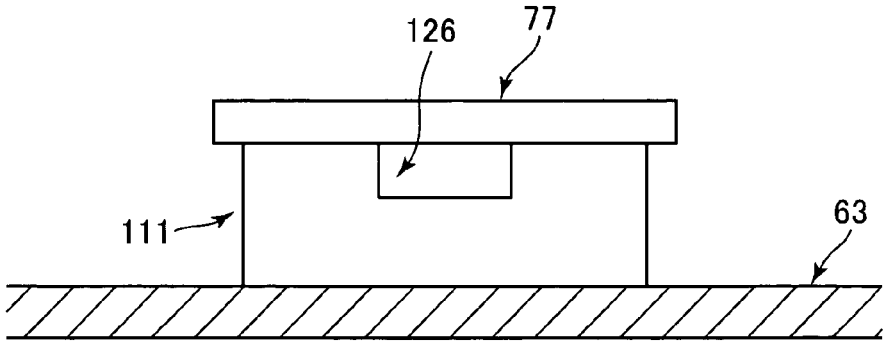
FIG. 10B is a view taken along the line A-A in FIG. 10A viewed in the direction indicated by the arrows in the drawing.
Figure 10C:
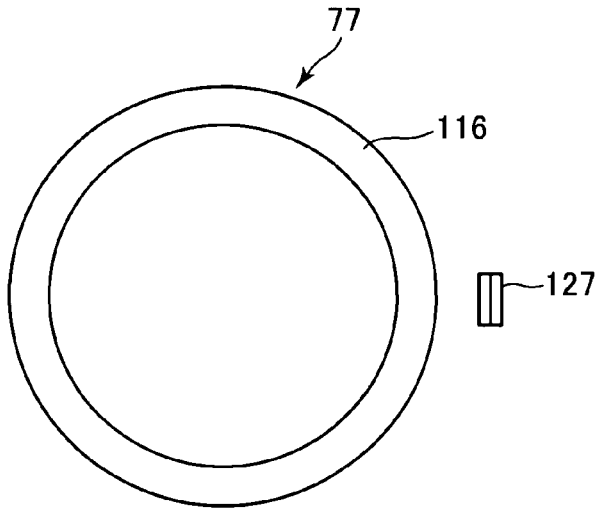
FIG. 10C is a view of the filling-port side cylindrical portion viewed from the direction B in FIG. 10A.

The arrangement of the above-described fifth modification may be modified as shown in FIG. 10A, FIG. 10B, and FIG. 10C. That is, the filling-port cylindrical portion 111 may be partially cut to form a through-hole 126 at a part of its area where the filling-port cylindrical portion 111 contacts the cylindrical portion 123*a* of the cap 77. In this case, the development casing 63 is formed with a protruding wall portion 127 that protrudes from the left side wall 67 to the outside of the development casing 63. The protruding wall portion 127 is located opposing the through-hole 126 of the filling-port cylindrical portion 111. To help easy understanding, showing of the protruding wall portion 127 is omitted from FIG. 10B. As shown in FIG. 10B, the outer peripheral surface of the cylindrical portion 123*a* of the cap 77 is exposed through the through-hole 126.

In this case, in order to refill toner in the toner accommodating chamber 85 for recycle use, the tip end of the detachment tool 128 is inserted through the through-hole 126 and is brought into contact with the exposed surface of the cap 77. Then, the detachment tool 128 is pivoted about the apex of the protruding wall portion 127, which serves as a fulcrum of a lever. Thus, the cap 77 can be easily detached from the filling-port cylindrical portion 111 without damaging the tip end surface 114.

In the present modification, no protruding portion is formed at the contact portion between the tip end surface 114 and the cap 77. However, a protruding portion may be formed on at least one of the tip end surface 114 and the cap 77 at the contact portion between the tip end surface 114 and the cap 77. The protruding portion protrudes toward the other one of the tip end surface 114 and the cap 77. In this case, the cap 77 can be detached more easily when refilling toner for recycle use. After refilling toner and the cap 77 is pressed in the filling-port cylindrical portion 111, the filling-port cylindrical portion 111 and the flange portion 116 of the cap 77 are ultrasonically welded to each other. Therefore, toner can be prevented from leaking through the filling-port cylindrical portion 111.

In the above-described first embodiment and its modifications, whether or not a developer cartridge 31 has once been subjected to refilling of toner can be determined reliably, depending on whether the cap 77 is pressingly inserted in the filling-port cylindrical portion 111 or is ultrasonically welded to the filling-port cylindrical portion 111. That is, if a cap 77 is pressingly inserted in the filling-port cylindrical portion 111, the developer cartridge 31 can be determined as not having been subjected to refilling of toner. Otherwise, if a cap 77 is ultrasonically welded to the filling-port cylindrical portion 111, the developer cartridge 31 can be determined as having been subjected to refilling of toner.

It is noted that in the above description, the same cap 77 is used before and after refilling. However, if the cap 77 is damaged when the cap 77 is detached, a new cap 77 is used after refilling.

In the above-described first embodiment and modifications, the filling-port cylindrical portion 111 is of a circular cylindrical shape having a circular cross-section. However, the filling-port cylindrical portion 111 needs not always have a circular cylindrical shape as long as this portion has a cylindrical shape that has the same cross-section over its entire axial length.

The through-hole 126 shown in FIG. 10A and FIG. 10B may be formed in the filling-port cylindrical portion 111 in any of the first embodiment and the first through fourth embodiments. In this case, the developing cartridge 63 may be provided with the protruding wall portion 127 shown in FIGS. 10A and 10C.

In the first embodiment and its first through fourth and sixth modifications, as apparent from FIG. 4A-FIG. 8B and FIG. 10A-FIG. 10B, the flange portion 116 has the radially-outwardly extending portion 116*b* similarly to the fifth modification. However, in the first embodiment and in its first through fourth and sixth modifications, the flange portion 116 may not have the radially-outwardly extending portion 116*b*, but may have only the radially-inner portion 116*a*. That is, the flange portion 116 may have the outer diameter equal to that of the filling-port cylindrical portion 111. In other words, the flange portion 116 may extend only between the inner and outer circumferential edges of the tip end surface 114 in the first embodiment and in its first through fourth and sixth modifications.

Second Embodiment

In the above-described first embodiment and its modifications, the cap 77 is pressingly fitted in the filling port 76 for the initial use of the developer cartridge 31 and the same cap 77 is pressingly fitted in the filling port 76 and is ultrasonically welded for the recycled use of the developer cartridge 31. Thus, the same cap 77 is used both for the initial use and the reuse of the developer cartridge 31.

On the other hand, according to a second embodiment, one cap 177 is pressingly fitted in the filling port 76 for the initial use of the developer cartridge 31 and a refilling cap 218 different from the initial cap 177 is pressingly fitted in the filling port 76 for recycled use of the developer cartridge 31.

Figure 11A:
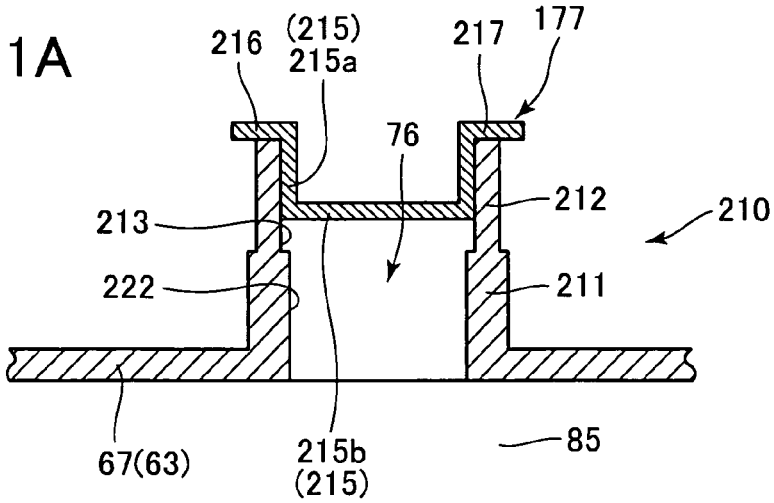
FIG. 11A is a cross-sectional view showing how a cap closes a filling port of the developer cartridge shown in FIG. 3 during an initial use according to a second embodiment.
Figure 11B:
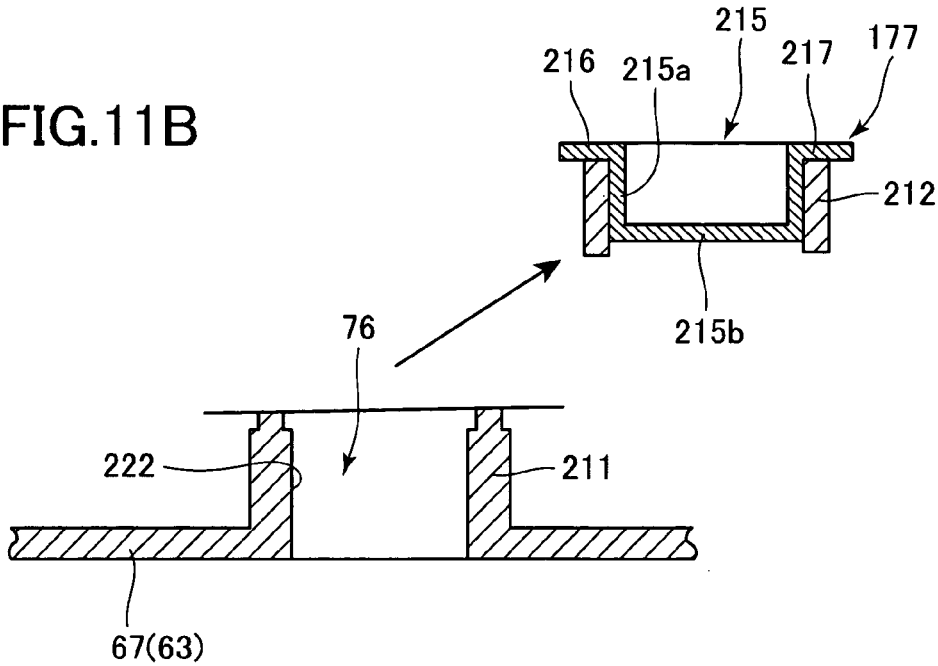
FIG. 11B is a cross-sectional view showing how the filling port is opened to refill toner in the developer cartridge to reuse the developer cartridge according to the second embodiment.
Figure 11C:
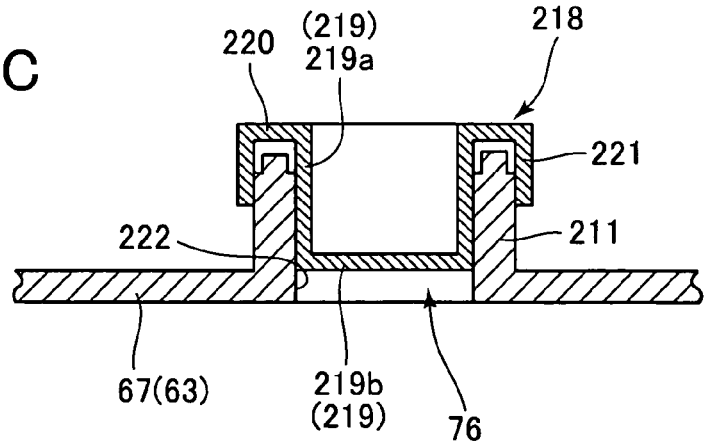
FIG. 11C is a cross-sectional view showing how a refilling cap closes the filling port after toner is refilled in the developer cartridge according to the second embodiment.

FIG. 11A to FIG. 11C are cross-sectional views showing the second embodiment of the structure near the filling port 76. In FIG. 11A to FIG. 11C, those portions that respectively correspond to portions shown in FIGS. 4A to 10C are denoted by the identical reference numerals to those shown in FIGS. 4A to 10C. From the following, detailed descriptions of those portions denoted by the identical reference numerals will be omitted.

According to the second embodiment, instead of the filling-port cylindrical portion 111 in the first embodiment, a filling-port cylindrical portion 210 is formed on the left side wall 67 of the development cartridge 31 as shown in FIG. 11A. Similarly to the filling-port cylindrical portion 111 in the first embodiment, the filling-port cylindrical portion 210 is provided at the circumferential edge of the circular filling port 76 and protrudes to the outside of the development casing 63.

The filling-port cylindrical portion 210 is substantially of a hollow circular cylindrical shape. The filling-port cylindrical portion 210 has a base end side part 211 and a tip end side part 212 that are arranged along the axis of the filling-port cylindrical portion 210. The base end side part 211 is elongated substantially half of the entire length of the filling-port cylindrical portion 210. The tip end side part 212 is elongated also substantially half of the entire length of the filling-port cylindrical portion 210. The base end side part 211 serves as a base part of the filling-port cylindrical portion 210, and is nearer to the left side wall 67 than the tip end side part 212. The tip end side part 212 is slightly thinner than the base end side part 211. The base end side part 211 has an inner peripheral surface 222, and the tip end side part 212 has an inner peripheral surface 213.

During the initial use of the developer cartridge 31, after filling the toner in the toner accommodating chamber 85, a cap 177 is used to close the filling port 76 as shown in FIG. 11A. The cap 177 integrally has an insertion portion 215 and a flange portion 216. The insertion portion 215 is of a bottomed circular cylindrical shape. In other words, the insertion portion 215 has a cylindrical portion 215*a* and a bottom portion 215*b*. The cylindrical portion 215*a* is of a hollow circular cylindrical shape, and the bottom portion 215*b* is of a circular shape. The flange portion 216 is of a circular ring shape. The bottom portion 215*b* extends radially inwardly from one axial end of the cylindrical portion 215*a* to close the one axial end of the cylindrical portion 215*a*. The flange portion 216 extends radially outwardly from the other axial end of the cylindrical portion 215*a*, while maintaining the other axial end of the cylindrical portion 215*a* to be opened.

The insertion portion 215 of the cap 177 is pressingly inserted into the filling-port cylindrical portion 210. As a result, the outer peripheral surface of the cylindrical portion 215*a* is air-tightly fitted on the inner peripheral surface 213 of the tip end side part 212 of the filling-port cylindrical portion 210. The flange portion 216 contacts a tip end surface 217 of the filling-port cylindrical portion 210.

When the toner in the toner accommodating chamber 85 is consumed up, the developer cartridge 31 is detached from the body casing 2 and replaced with another developer cartridge filled with toner. The empty developer cartridge 31 is collected by the manufacturer of the laser printer 1 and recycled by refilling toner in the toner accommodating chamber 85.

According to the present embodiment, in order to refill toner in the toner accommodating chamber 85, the cap 177, which is pressingly fitted in the tip end side part 212 of the filling-port cylindrical portion 210, is removed together with the tip end side part 212 of the filling port cylindrical portion 210, as shown in FIG. 11B. As a result of this, almost only the base end side part 211 of the filling port cylindrical portion 210 remains on the development casing 63. The filling port 76 opens again, inside the base end side part 211.

Toner is refilled in the toner accommodating chamber 85 through the filling port 76 opened as described above. Thereafter, the filling port 76 is closed by using a refilling cap 218 as shown in FIG. 1C.

The refilling cap 218 integrally has an insertion portion 219, a flange portion 220, and a folding-back portion 221. The insertion portion 219 is of a bottomed circular cylindrical shape. In other words, the insertion portion 219 includes a cylindrical portion 219*a* and a bottom portion 219*b*. The cylindrical portion 219*a* is of a hollow circular cylindrical shape, and the bottom portion 219*b* is of a circular shape. The flange portion 220 is of a circular ring shape. The bottom portion 219*b* extends radially inwardly from one axial end of the cylindrical portion 219*a* to close the one axial end of the cylindrical portion 219*a*. The flange portion 220 extends radially outwardly from the other axial end of the cylindrical portion 219*a*, while maintaining the other axial end of the cylindrical portion 219*a* to be opened. The folding-back portion 221 is formed by folding back an outer circumferential edge portion of the flange portion 220, and has a circular cylindrical shape coaxial with the cylindrical portion 219*a*.

The insertion portion 219 of the refilling cap 218 is pressingly inserted in the base end side part 211 of the filling-port cylindrical portion 210. The outer peripheral surface of the cylindrical portion 219a is fitted to the inner peripheral surface 222 of the base end side part 211. The folding-back portion 221 is fitted on the outer peripheral surface of the base end side part 211. The cylindrical portion 219*a* and the folding-back portion 221 sandwich and hold the base end side part 211 therebetween.

Thus, according to the present embodiment, before refilling toner, the cap 177 is received by the filling-port cylindrical portion 210, while being fitted on the inner peripheral surface 213 of the tip end side part 212, thereby closing the filling port 76. After refilling toner, the refilling cap 218 is received by the filling-port cylindrical portion 210, while being fitted on the inner peripheral surface 222 of the base end side part 211, to close the filling port 76. After refilling, the filling port 76 is closed by the refilling cap 218 fitted on the inner peripheral surface 222 that is different from the inner peripheral surface 213 that has been used for receiving the cap 177 before refilling. Accordingly, it is possible to maintain the sealing performance also after refilling.

The filling port 76 can be easily opened by removing the cap 177 and the tip end side part 212 of the filling-port cylindrical portion 210 together. By removing the cap 177 together with the tip end side part 212, the filling port 76 is opened easily and reliably.

Whether or not a developer cartridge 31 has once been subjected to refilling of toner can be determined reliably, depending on whether the cap 177 contacts the inner peripheral surface 213 of the tip end side part 212 or the refilling cap 218 contacts the inner peripheral surface 222 of the base end side part 211. That is, if the cap 177 contacts the inner peripheral surface 213 of the tip end side part 212, the developer cartridge 31 can be determined as not having been subjected to refilling of toner. Otherwise, if a refilling cap 218 contacts the inner peripheral surface 222 of the base end side part 211, the developer cartridge 31 can be determined as having been subjected to refilling of toner.

Third Embodiment

Figure 12A:
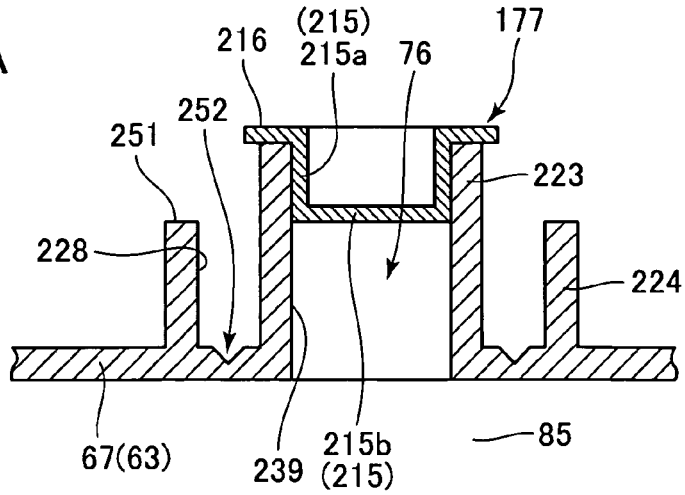
FIG. 12A is a cross-sectional view showing how a cap closes a filling port of the developer cartridge shown in FIG. 3 during an initial use according to a third embodiment.
Figure 12B:
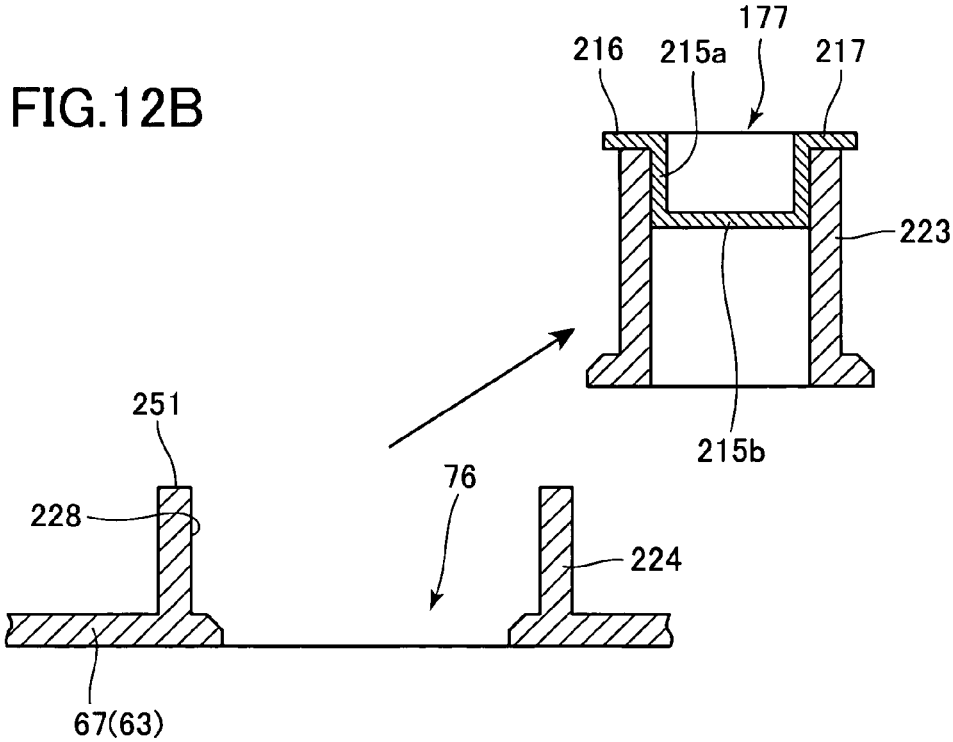
FIG. 12B is a cross-sectional view showing how the filling port is opened to refill toner in the developer cartridge to reuse the developer cartridge according to the third embodiment.
Figure 12C:
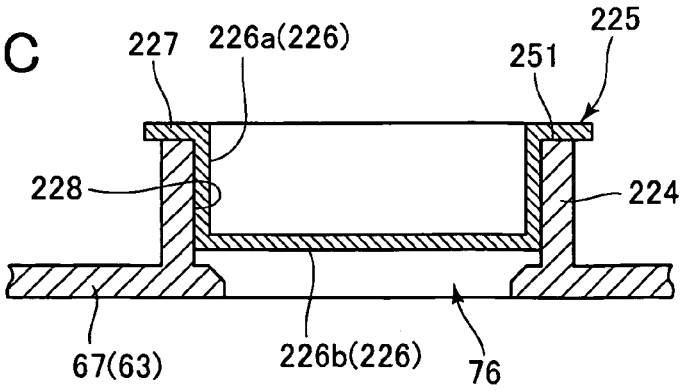
FIG. 12C is a cross-sectional view showing how a refilling cap closes the filling port after toner is refilled in the developer cartridge according to the third embodiment.

FIG. 12A to FIG. 12C are cross-sectional views showing the third embodiment of the structure near the filling port 76. In FIG. 12A to FIG. 12C, those portions that respectively correspond to portions shown in FIG. 11A to FIG. 11C are denoted by the identical reference numerals to those shown in FIG. 11A to FIG. 11C. From the following, detailed descriptions of those portions denoted by the identical reference symbols will be omitted.

According to the present embodiment, the developer cartridge 31 has a filling-port inner cylindrical portion 223 and a filling-port outer cylindrical portion 224, as shown in FIG. 12A, instead of the filling-port cylindrical portion 210 in the second embodiment. Both of the filling-port inner cylindrical portion 223 and the filling-port outer cylindrical portion 224 protrude from the left side wall 67 to the outside of the developer cartridge 31. The filling-port inner cylindrical portion 223 protrudes from the peripheral edge of the filling port 76. The filling-port outer cylindrical portion 224 is provided surrounding the outer circumference of the filling-port inner cylindrical portion 223, and is coaxial with respect to the filling-port inner cylindrical portion 223. Both of the filling-port inner cylindrical portion 223 and the filling-port outer cylindrical portion 224 are in a hollow circular cylindrical shape. The filling-port inner cylindrical portion 223 protrudes by a greater protruding amount from the left side wall 67 of the development casing 63, compared with the filling-port outer cylindrical portion 224.

During the initial use of the developer cartridge 31, the insertion portion 215 of the cap 177 is pressingly inserted in the filling-port inner cylindrical portion 223. The outer peripheral surface of the cylindrical portion 215*a* is air-tightly fitted to an inner peripheral surface 239 of the filling-port inner cylindrical portion 223.

According to the present embodiment, on the left side wall 67 of the development casing 63, a groove 252 is formed on an outer surface of the left side wall 67 in a circular ring shape surrounding the filling-port inner cylindrical portion 223, at a location between the filling-port inner cylindrical portion 223 and the filling-port outer cylindrical portion 224. The groove 252 has a V-shaped cross-section. The groove 252 enables the filling-port inner cylindrical portion 223 to be easily separated from the left side wall 67, as will be described next with reference to FIG. 12B.

In order to refill toner in the toner accommodating chamber 85, the left side wall 67 is cut along the groove 252 as shown in FIG. 12B. The filling-port inner cylindrical portion 223 is removed together with the cap 177, from the base end of the filling-port cylindrical portion 223. As a result, the filling port 76 is opened at a location within the filling-port outer cylindrical portion 224.

After refilling toner in the toner accommodating chamber 85 through the opened filling port 76, the filling port 76 is closed by a refilling cap 225 as shown in FIG. 12C. The refilling cap 225 integrally has an insertion portion 226 and a flange portion 227. The insertion portion 226 is of a bottomed circular cylindrical shape. In other words, the insertion portion 226 has a cylindrical portion 226*a* and a bottom portion 226*b*. The cylindrical portion 226*a* is of a hollow circular cylindrical shape, and the bottom portion 226*b* is of a circular shape. The flange portion 227 is of a circular ring shape. The bottom portion 226*b* extends radially inwardly from one axial end of the cylindrical portion 226*a* to close the one axial end of the cylindrical portion 226*a*. The flange portion 227 extends radially outwardly from the other axial end of the cylindrical portion 226*a*, while maintaining the other axial end of the cylindrical portion 226*a* to be opened.

The insertion portion 226 of the refilling cap 225 is pressingly inserted in the filling-port outer cylindrical portion 224, with the outer peripheral surface of the cylindrical portion 226*a* being air-tightly fitted on an inner peripheral surface 228 of the filling-port outer cylindrical portion 224. The flange portion 227 contacts a tip end surface 251 of the filling-port outer cylindrical portion 224.

Thus, according to the present embodiment, before refilling toner, the cap 177 is received by the filling-port inner cylindrical portion 223, with the cylindrical portion 215*a* being fitted on the inner peripheral surface 239 of the filling-port inner cylindrical portion 223. After refilling, the refilling cap 225 is received by the filling-port outer cylindrical portion 224, with the cylindrical portion 226*a* of the cap 225 being fitted on the inner peripheral surface 228 of the filling-port outer cylindrical portion 224.

After refilling, the filling port 76 is closed by the refilling cap 225 fitted on the inner peripheral surface 228 that is different from the inner peripheral surface 239 that has been used for receiving the cap 177 before refilling. Accordingly, it is possible to maintain the sealing performance also after refilling.

When opening the filling port 76, the cap 177 and the entire filling-port inner cylindrical portion 223 are removed. As a result, the filling port 76 can be easily reopened. By removing the cap 177 and the entire filling-port inner cylindrical portion 223 together, it is ensured that the filling port 76 is opened with a greater size.

Thus, the entire filling-port inner cylindrical portion 223 is removed together with the cap 177, thereby to open the filling port 76 enlarged. The filling-port outer cylindrical portion 224 surrounds the outer circumference of the filling-port inner cylindrical portion 223. The refilling cap 225 is received by the filling-port outer cylindrical portion 224, so that the filling port 76 opened enlarged can be reliably closed, maintaining excellent sealing performance.

Furthermore, the cylindrical portion 226*a* of the refilling cap 225 fits on the inner peripheral surface 228 of the filling-port outer cylindrical portion 224. The flange portion 227 of the refilling cap 225 fits on the tip end surface 251 of the filling-port outer cylindrical portion 224. Therefore, the filling port 76 can be closed reliably by the refilling cap 225, maintaining excellent sealing performance.

Whether a developer cartridge 31 has once been subjected to refilling of toner or not can be determined reliably, depending on whether a cap 177 contacts the inner peripheral surface 239 of the filling-port inner cylindrical portion 223 or a refilling cap 225 contacts the inner peripheral surface 228 of the filling-port outer cylindrical portion 224. That is, if the cap 177 contacts the inner peripheral surface 239 of the filling-port inner cylindrical portion 223, the developer cartridge 31 can be determined as not having been subjected to refilling of toner. Otherwise, if a refilling cap 225 contacts the inner peripheral surface 228 of the filling-port outer cylindrical portion 224, the developer cartridge 31 can be determined as having been subjected to refilling of toner.

Fourth Embodiment

Figure 13A:
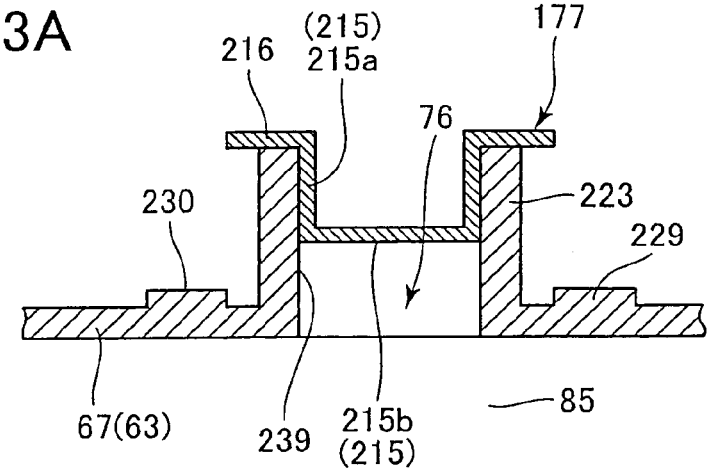
FIG. 13A is a cross-sectional view showing how a cap closes a filling port of the developer cartridge shown in FIG. 3 during an initial use according to a fourth embodiment.
Figure 13B:
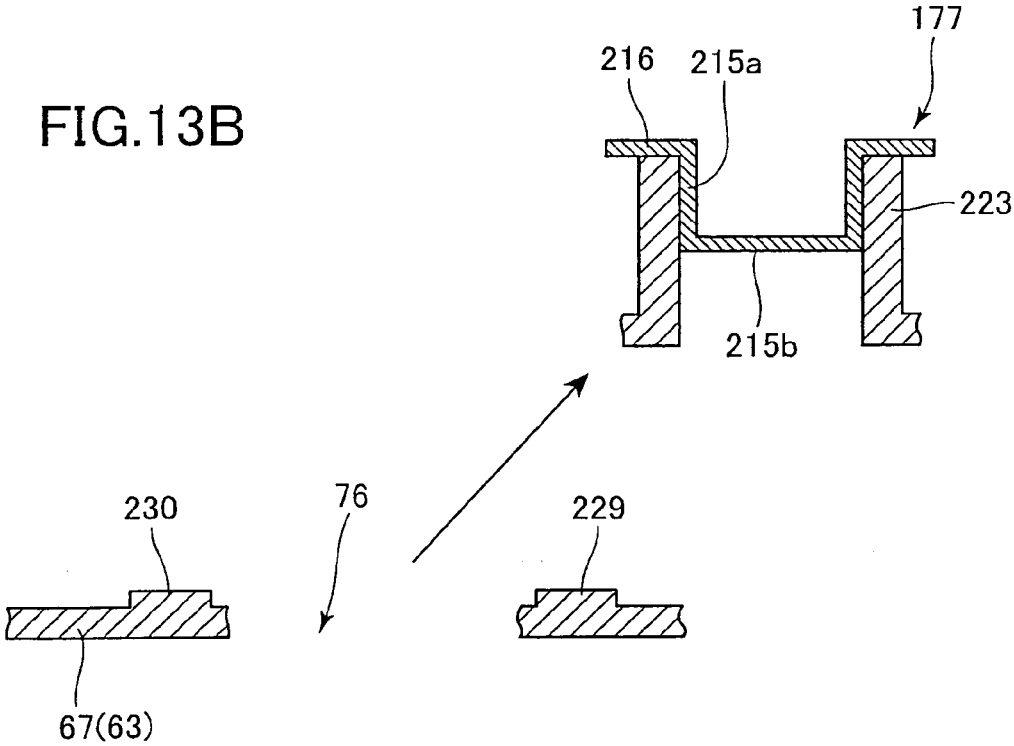
FIG. 13B is a cross-sectional view showing how the filling port is opened to refill toner in the developer cartridge to reuse the developer cartridge according to the fourth embodiment.
Figure 13C:
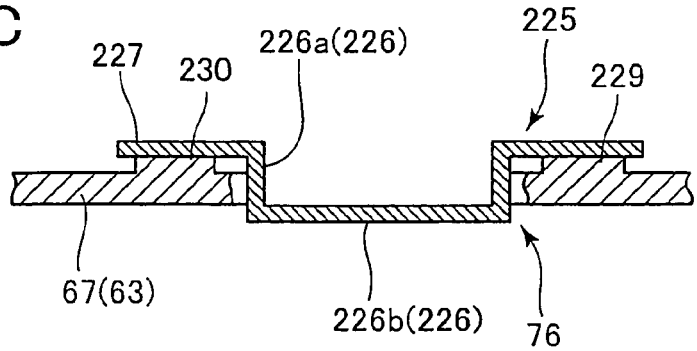
FIG. 13C is a cross-sectional view showing how a refilling cap closes the filling port after toner is refilled in the developer cartridge according to the fourth embodiment.

FIG. 13A to FIG. 13C are cross-sectional views showing the fourth embodiment of the structure near the filling port 76. In FIG. 13A to FIG. 13C, those portions that respectively correspond to portions shown in FIGS. 12A to 12C are denoted by the identical reference numerals to those shown in FIGS. 12A to 12C. From the following, detailed descriptions of those portions denoted by the identical reference numerals will be omitted.

The arrangement according to the present embodiment is the same as that of the third embodiment except that the groove 252 is not formed on the left side wall 67 and that the developer cartridge 31 has an outer seat portion 229, as shown in FIG. 13A, instead of the filling-port outer cylindrical portion 224 in the third embodiment.

The outer seat portion 229 is provided surrounding the outer circumference of the filling-port inner cylindrical portion 223. The outer seat portion 229 may have a circular ring shape that is coaxial with the filling-port inner cylindrical portion 223 and that does not substantially protrude from the left side wall 67. Or, the outer seat portion 229 may have a circular cylindrical shape that is coaxial with the filling-port inner cylindrical portion 223 and that protrudes from the left side wall 67 with a protruding amount that is much smaller than that of the filling-port inner cylindrical portion 223.

In order to refill toner in the toner accommodating chamber 85, the filling-port inner cylindrical portion 223 is cut and removed, from the base end of the filling-port inner cylindrical portion 223, as shown in FIG. 13B. The cap 177 is removed together with the filling-port inner cylindrical portion 223. As a result, the filling port 76 is opened inside the outer seat portion 229, in the development casing 63.

After toner is refilled in the toner accommodating chamber 85 through the opened filling port 76, the insertion portion 226 of the refilling cap 225 is inserted in the filling port 76 as shown in FIG. 13C. A surface of the flange portion 227 confronting the left side wall 67 is welded or bonded to a tip end surface 230 of the outer seat portion 229. In this manner, the filling port 76 is closed by the refilling cap 225.

As described above, according to the present embodiment, before refilling toner, the cap 177 is received by the filling-port inner cylindrical portion 223, with the cylindrical portion 215*a* of the cap 177 being fitted on the inner peripheral surface 239 of the filling-port inner cylindrical portion 223. After refilling, the refilling cap 225 is received by the outer seat portion 229, with the flange portion 227 fixed on the tip end surface 230 of the outer seat portion 229.

After refilling, the filling port 76 is closed by the refilling cap 225 fitted on the tip end surface 230 that is different from the inner peripheral surface 239 that has been used for receiving the cap 177 before refilling. Accordingly, it is possible to maintain the sealing performance also after refilling.

When opening the filling port 76, the cap 177 and the entire filling-port inner cylindrical portion 223 are removed. As a result, the filling port 76 can be easily and reliably opened to be enlarged. The entire filling-port inner cylindrical portion 223 is removed together with the cap 177 to open the filling port 76 enlarged. The outer seat portion 229 is formed surrounding the outer circumference of the filling-port inner cylindrical portion 223. The refilling cap 225 is received by the outer seat portion 229. Accordingly, the enlarged, opened filling port 76 can be reliably closed by the refilling cap 225, maintaining excellent sealing performance.

Whether a developer cartridge 31 has once been subjected to refilling of toner or not can be determined reliably, depending on whether a cap 177 contacts the inner peripheral surface 239 of the filling-port inner cylindrical portion 223 or a refilling cap 225 contacts the tip end surface 230 of the outer seat portion 229. That is, if the cap 177 contacts the inner peripheral surface 239 of the filling-port inner cylindrical portion 223, the developer cartridge 31 can be determined as not having been subjected to refilling of toner. Otherwise, if a refilling cap 225 contacts the tip end surface 230 of the outer seat portion 229, the developer cartridge 31 can be determined as having been subjected to refilling of toner.

The groove 252 may be formed between the filling-port inner cylindrical portion 223 and the outer seat portion 229 similarly to the third embodiment. The filling-port inner cylindrical portion 223 can be easily removed by cutting the filling-port inner cylindrical portion 223 along the groove 252.

Fifth Embodiment

Figure 14A:
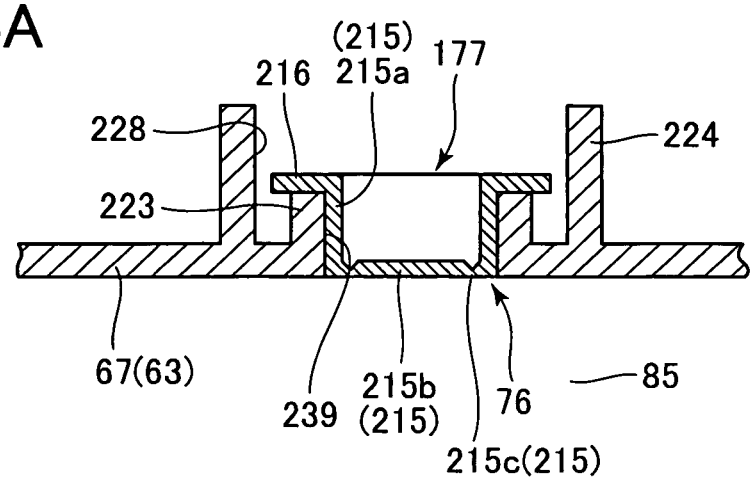
FIG. 14A is a cross-sectional view showing how a cap closes a filling port of the developer cartridge shown in FIG. 3 during an initial use according to a fifth embodiment.
Figure 14B:
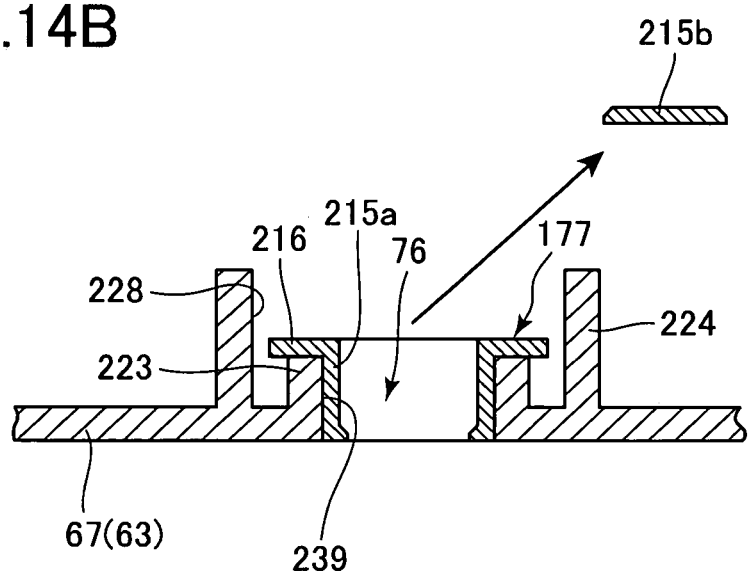
FIG. 14B is a cross-sectional view showing how the filling port is opened to refill toner in the developer cartridge to reuse the developer cartridge according to the fifth embodiment.
Figure 14C:
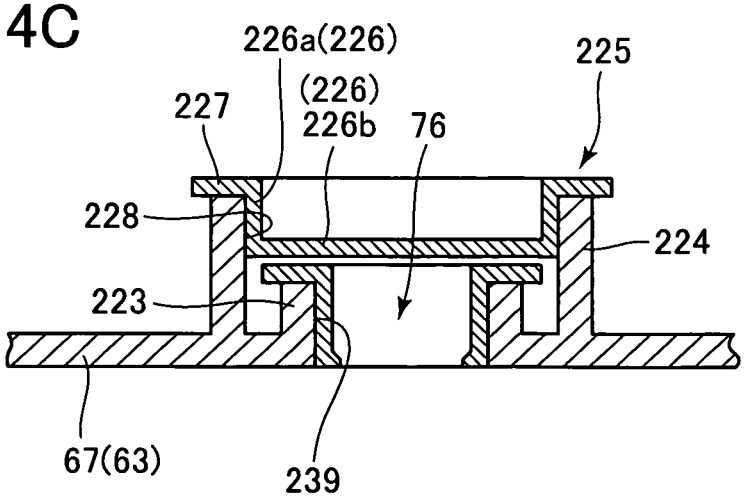
FIG. 14C is a cross-sectional view showing how a refilling cap closes the filling port after toner is refilled in the developer cartridge according to the fifth embodiment.

FIG. 14A to FIG. 14C are cross-sectional views showing the fifth embodiment of the structure near the filling port 76. In FIG. 14A to FIG. 14C, those portions that respectively correspond to portions shown in FIG. 12A to FIG. 12C are denoted by the identical reference numerals to those shown in FIG. 12A to FIG. 12C. From the following, detailed descriptions of those portions denoted by the identical reference symbols will be omitted.

The arrangement according to the present embodiment is different from that of the third embodiment of FIGS. 12A-12C in that, as shown in FIG. 14A, the filling-port outer cylindrical portion 224 protrudes from the left side wall 67 by a greater amount than the filling-port inner cylindrical portion 223. The groove 252 is not formed, but instead a circumferential edge portion 215*c* of the bottom portion 215*b* is slightly thinner than a central portion thereof. Thus, the bottom portion 215*b* can be easily cut out when refilling toner as will be described next. In other words, a groove is formed along the circumferential edge portion 215*c* of the bottom portion 215*b*.

In order to refill toner in the toner accommodating chamber 85, the circumferential edge portion 215*c* of the bottom portion 215*b* is cut with a cutting tool, as shown in FIG. 14B, to remove the bottom portion 215*b* only. As a result, the filling port 76 is opened inside the cylindrical portion 215*a* of the cap 177.

After refilling toner in the toner accommodating chamber 85 through the opened filling port 76, the insertion portion 226 of the refilling cap 225 is pressingly inserted in the filling-port outer cylindrical portion 224, as shown in FIG. 14C. The refilling cap 225 is received by the filling-port outer cylindrical portion 224, with the outer peripheral surface of the cylindrical portion 226*a* being air-tightly fitted on the inner peripheral surface 228 of the filling-port outer cylindrical portion 224. The filling port 76 is thus closed by the refilling cap 225.

According to the structure as described above, before refilling toner, the cap 177 is received by the filling-port inner cylindrical portion 223, with the cap 177 being fitted on the inner peripheral surface 239 of the filling-port inner cylindrical portion 223. After refilling, the refilling cap 225 is received by the filling-port outer cylindrical portion 224, with the refilling cap 225 being fitted on the inner peripheral surface 228 of the filling-port outer cylindrical portion 224. After refilling, the filling port 76 is closed by the refilling cap 225 fitted on the inner peripheral surface 228 that is different from the inner peripheral surface 239 that has been used for receiving the cap 177 before refilling. Accordingly, it is possible to maintain the sealing performance also after refilling.

When opening the filling port 76, the bottom portion 215*b*, that is, a part of the cap 177, is removed. Thus, the filling port 76 can be easily and reliably opened.

Whether a developer cartridge 31 has once been subjected to refilling of toner or not can be determined reliably, depending on whether a cap 177 contacts the inner peripheral surface 239 of the filling-port inner cylindrical portion 223 or a refilling cap 225 contacts the inner peripheral surface 228 of the filling-port outer cylindrical portion 224. That is, if the cap 177 contacts the inner peripheral surface 239 of the filling-port inner cylindrical portion 223, the developer cartridge 31 can be determined as not having been subjected to refilling of toner. Otherwise, if a refilling cap 225 contacts the inner peripheral surface 228 of the filling-port outer cylindrical portion 224, the developer cartridge 31 can be determined as having been subjected to refilling of toner.

Sixth Embodiment

Figure 15A:
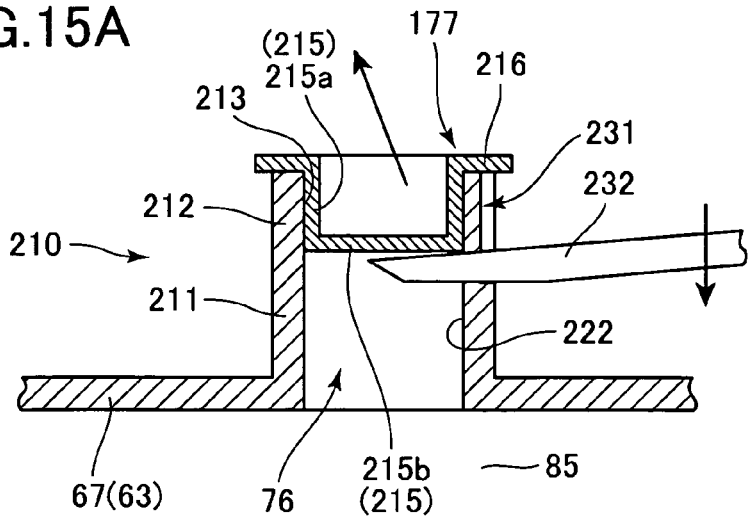
FIG. 15A is a cross-sectional view showing how a cap closes the filling port of the developer cartridge during an initial use according to a sixth embodiment.
Figure 15B:
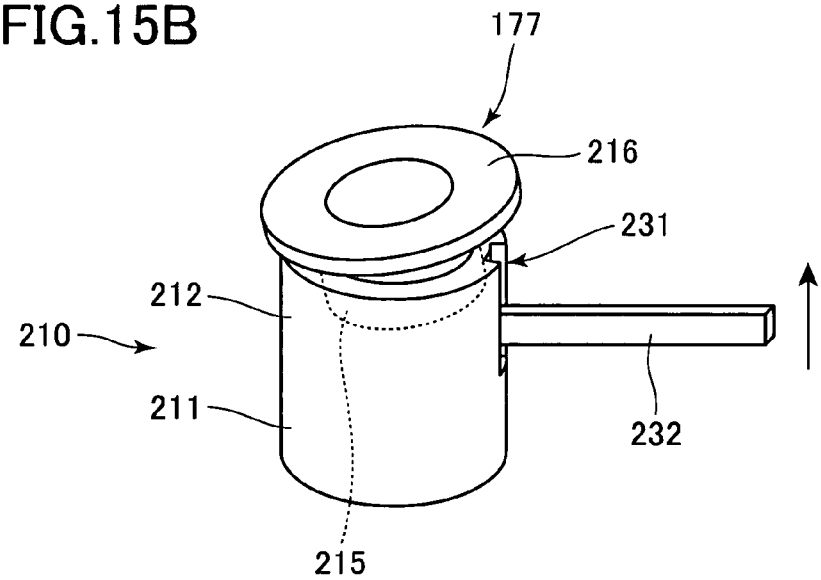
FIG. 15B illustrates how to detach the cap to open the filling port according to the sixth embodiment.
Figure 15C:
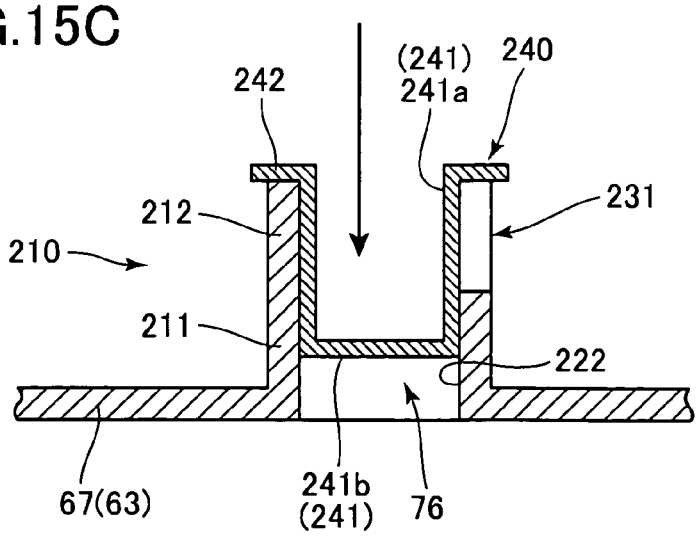
FIG. 15C is a cross-sectional view showing how a refilling cap closes the filling port after toner is refilled in the developer cartridge according to the sixth embodiment.

FIG. 15A-FIG. 15C illustrate the fifth embodiment of the structure near the filling port 76. In FIG. 15A to FIG. 15C, those portions that respectively correspond to portions shown in FIG. 11A to FIG. 11C are denoted by the identical reference numerals to those shown in FIG. 11A to FIG. 11C. From the following, detailed descriptions of those portions denoted by the identical reference numerals will be omitted.

As shown in FIG. 15A, the filling-port cylindrical portion 210 has a substantially uniform thickness over the entire axial length. The inner peripheral surface 213 of the tip end side part 212 and the inner peripheral surface 222 of the base end side part 211 are continuous to each other without any steps being formed therebetween. As shown in FIG. 15A and FIG. 15B, an insertion groove 231 is formed in the tip end side part 212 of the filling-port cylindrical portion 210. The insertion groove 231 is formed on the outer peripheral surface of the filling-port cylindrical portion 210 as being recessed along the axial direction of the tip end side part 212. The tip end side part 212 is thinner than the other part at its region where the insertion groove 231 is formed. The insertion portion 215 of the cap 177 is pressingly inserted in the tip end side part 212 of the filling-port cylindrical portion 210.

In order to refill toner in the toner accommodating chamber 85, as shown in FIGS. 15A and 15B, a cutting tool 232 is inserted through the insertion groove 231 at its lower position. Then, the cutting tool 232 is moved axially in a direction away from the left side wall 67, thereby cutting the tip end side part 212 along the insertion groove 231 in a direction away from the left side wall 67 and pushing the cap 177 in a direction away from the left side wall 67. As a result, the cap 177 is detached from the filling-port cylindrical portion 210, and the filling port 76 is opened inside the filling-port cylindrical portion 210.

After refilling toner in the toner accommodating chamber 85 through the opened filling port 76, the filling port 76 is closed by a refilling cap 240 as shown in FIG. 15C. The refilling cap 240 integrally has an insertion portion 241 and a flange portion 242. The insertion portion 241 is of a bottomed circular cylindrical shape. In other words, the insertion portion 241 has a cylindrical portion 241*a* and a bottom portion 241*b*. The cylindrical portion 241*a* is of a hollow circular cylindrical shape, and the bottom portion 241*b* is of a circular shape. The flange portion 242 is of a circular ring shape. The bottom portion 241*b* extends radially inwardly from one axial end of the cylindrical portion 241*a* to close the one axial end of the cylindrical portion 241*a*. The flange portion 242 extends radially outwardly from the other axial end of the cylindrical portion 241*a*, while maintaining the other axial end of the cylindrical portion 241*a* to be opened. The cylindrical portion 241*a* is longer in the axial direction than the insertion groove 231 in the filling-port cylindrical portion 210. Therefore, when the refilling cap 240 is inserted in the filling-port cylindrical portion 210, the bottom end part of the cylindrical portion 241*a* is pressed to the base end side part 211 of the filling-port cylindrical portion 210. Accordingly, the outer peripheral surface of the cylindrical portion 241*a* at its bottom end part is air-tightly fitted on the inner peripheral surface 222 of the base end side part 211.

As described above, according to the present embodiment, before refilling toner, the cap 177 is received by the filling-port cylindrical portion 210, while being fitted on the inner peripheral surface 213 of the tip end side part 212. After refilling, the refilling cap 240 is received also by the filling-port cylindrical portion 210, while being fitted on the inner peripheral surface 222 of the base end side part 211 of the tip end side part 212. There may be a case that the inner peripheral surface 213 is damaged when the cap 177 is removed from the inner peripheral surface 213 of the tip end side part 212. Even in this case, the filling port 76 after refilling can be reliably closed by the refilling cap 240 that is fitted on the inner peripheral surface 222 different from the inner peripheral surface 213, thereby maintaining sealing performance.

Because the tip end side part 212 at the insertion groove 231 is thinner than the other remaining part of the filling-port cylindrical portion 210, the cap 177 can be easily removed from the tip end side part 212 by inserting the cutting tool 232 through the insertion groove 231. As a result, the filling port 76 can be easily and reliably opened.

When opening the filling port 76, the entire cap 177 is removed. Accordingly, the filling port 76 can be easily and reliably opened.

Whether a developer cartridge 31 has once been subjected to refilling of toner or not can be determined reliably, depending on whether a cap 177 contacts the inner peripheral surface 213 of the tip end side part 212 or a refilling cap 240 contacts the inner peripheral surface 222 of the base end side part 211, and depending on whether the insertion groove 231 has been cut or not. That is, if the cap 177 contacts the inner peripheral surface 213 of the tip end side part 212 and the insertion groove 231 has not yet been cut, the developer cartridge 31 can be determined as not having been subjected to refilling of toner. Otherwise, if the refilling cap 240 contacts the inner peripheral surface 222 of the base end side part 211 and the insertion groove 231 has been cut, the developer cartridge 31 can be determined as having been subjected to refilling of toner.

Seventh Embodiment

Figure 16A:
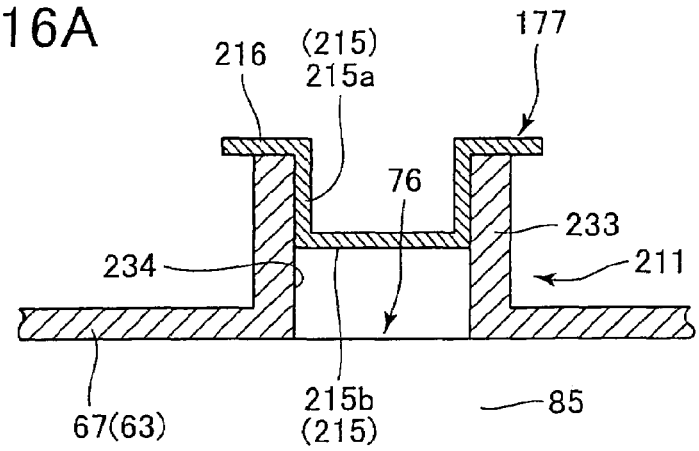
FIG. 16A is a cross-sectional view showing how a cap closes a filling port of the developer cartridge shown in FIG. 3 during an initial use according to a seventh embodiment.
Figure 16B:
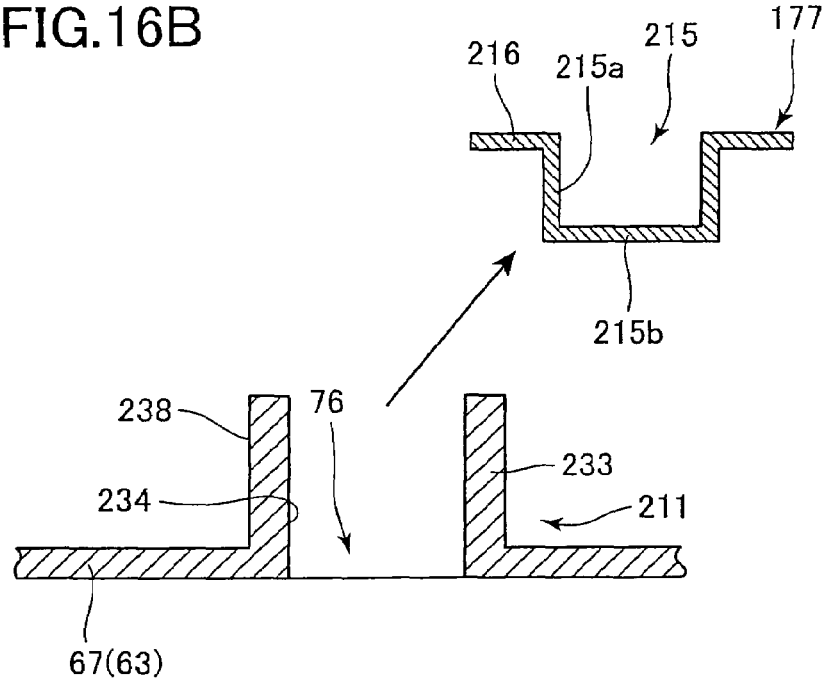
FIG. 16B is a cross-sectional view showing how the filling port is opened to refill toner in the developer cartridge to reuse the developer cartridge according to the seventh embodiment.
Figure 16C:
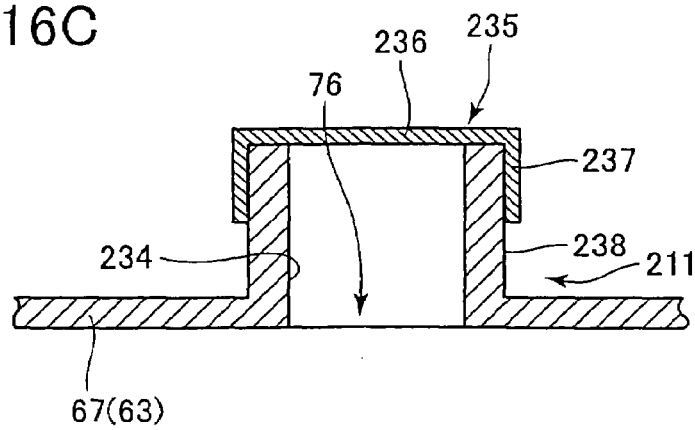
FIG. 16C is a cross-sectional view showing how a refilling cap closes the filling port after toner is refilled in the developer cartridge according to the seventh embodiment.

FIG. 16A to FIG. 16C are cross-sectional views showing the seventh embodiment of the structure near the filling port 76. In FIG. 16A to FIG. 16C, those portions that respectively correspond to portions shown in FIG. 11A to FIG. 11C are denoted by the identical reference numerals to those shown in FIG. 11A to FIG. 11C. From the following, detailed descriptions of those portions denoted by the identical reference numerals will be omitted.

According to the present embodiment, the developer cartridge 31 has a filling-port cylindrical portion 233. The filling-port cylindrical portion 233 is of a hollow circular cylindrical shape, and has an outer peripheral surface 238 and an inner peripheral surface 234. The filling-port cylindrical portion 233 protrudes from the circumferential edge of the circular filling port 76 on the left side wall 67 to the outside of the development casing 63. The outer diameter of the flange portion 216 of the cap 177 is greater than that of the filling-part cylindrical portion 233, in the same manner as in the fifth modification of the first embodiment.

During the initial use of the developer cartridge 31, the filling port 76 is closed by the cap 177 as shown in FIG. 16A. That is, the insertion portion 215 of the cap 177 is pressingly inserted in the filling-port cylindrical portion 233, with the outer peripheral surface of the cylindrical portion 215*a* contacting the inner peripheral surface 234 of the filling-port cylindrical portion 233, in the same manner as in the fifth modification of the first embodiment.

In order to refill toner in the toner accommodating chamber 85, the cap 177 is removed, as shown in FIG. 16B, in the same manner as in the fifth modification of the first embodiment. As a result, the filling port 76 is opened inside the filling-port cylindrical portion 233.

After refilling toner in the toner accommodating chamber 85 through the opened filling port 76, the filling port 76 is closed by a refilling cap 235 as shown in FIG. 16C. The refilling cap 235 integrally has a disk-shaped portion 236 and a cylindrical skirt portion 237 connected to an outer circumferential edge of the disk-shaped portion 236. The skirt portion 237 is formed to have an inner diameter slightly smaller than the outer diameter of the filling-port cylindrical portion 233. The refilling cap 235 is mounted, like a crown, on the filling-port cylindrical portion 233 such that the axial end portion of the filling-port cylindrical portion 233 is inserted in the skirt portion 237. The inner peripheral surface of the skirt portion 237 contacts the outer peripheral surface 238 of the filling-port cylindrical portion 233. The filling-port cylindrical portion 233 is pressingly inserted in the skirt portion 237 of the refilling cap 235. Thus, the filling port 76 is closed by the refilling cap 235.

According to the structure as described above, before refilling toner, the cap 177 is received by the filling-port cylindrical portion 233, with the cap 177 being fitted on the inner peripheral surface 234 of the filling-port cylindrical portion 233. After refilling, the refilling cap 235 is received by the filling-port cylindrical portion 233, with the refilling cap 235 being fitted on the outer peripheral surface 238 of the filling-port cylindrical portion 233. There may be a case that the inner peripheral surface 234 is damaged when the cap 177 is removed from the inner peripheral surface 234 of the filling-port cylindrical portion 233. Even in this case, the filling port 76 after refilling can be reliably closed by the refilling cap 235 that is fitted on the outer peripheral surface 238 different from the inner peripheral surface 234, thereby maintaining sealing performance.

When opening the filling port 76, the entire cap 177 is removed. Accordingly, the filling port 76 can be easily and reliably opened.

Furthermore, the structure is simplified because the filling-port cylindrical portion 233 is used both for receiving the cap 177 and for receiving the refilling cap 235. Still, the filling port 76 can be closed while maintaining the sealing performance through tight fit between the cap 177 and the inner peripheral surface 234 before refilling and through tight fit between the refilling cap 235 and the outer peripheral surface 238 after refilling.

Whether a developer cartridge 31 has once been subjected to refilling of toner or not can be determined reliably, depending on whether a cap 177 contacts the inner peripheral surface 234 of the filling-port cylindrical portion 233 or a refilling cap 235 contacts the outer peripheral surface 238 of the base end side part 211. That is, if the cap 177 contacts the inner peripheral surface 234 of the filling-port cylindrical portion 233, the developer cartridge 31 can be determined as not having been subjected to refilling of toner. Otherwise, if the refilling cap 235 contacts the outer peripheral surface 238 of the filling-port cylindrical portion 233, the developer-cartridge 31 can be determined as having been subjected to refilling of toner.

The structure of the cap 177 and the structure of the refilling cap 235 may be replaced with each other. That is, the cap 177 may be constructed in the same structure as the refilling cap 235 shown in FIG. 16C. Before refilling toner, the filling port 76 is closed by putting the cap 177 having the same structure with the refilling cap 235 of FIG. 16C, like a crown, on the filling-port cylindrical portion 233. The refilling cap 235 may be constructed in the same structure as the cap 177 shown in FIG. 16A. After refilling toner, the filling port 76 is closed by pressingly inserting the refilling cap 235 having the same structure with the cap 177 of FIG. 16A in the filling-port cylindrical portion 233.

<Modification>

A modification of the third embodiment will be described below.

Figure 17A:
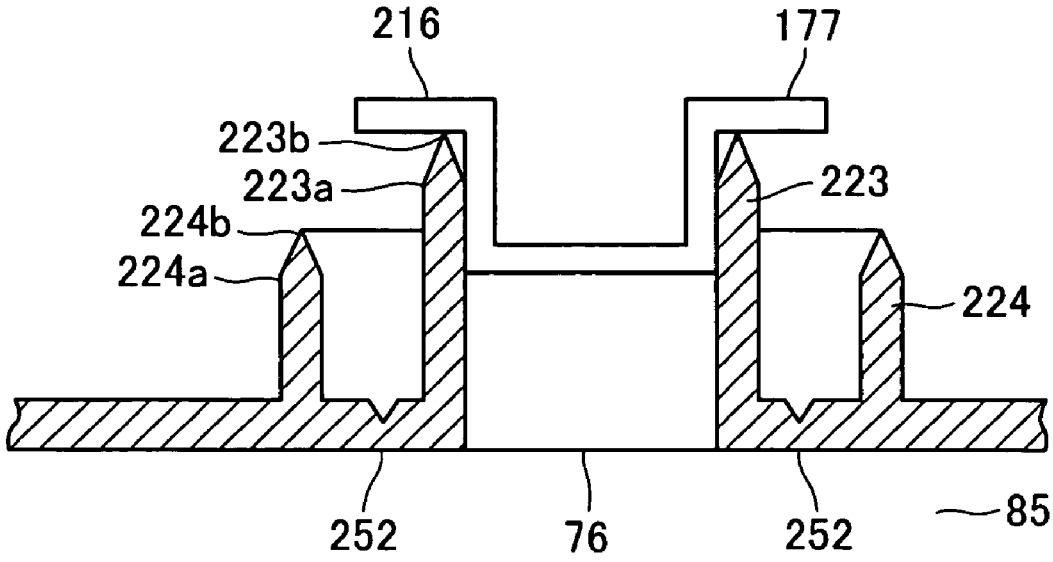
FIG. 17A is a cross-sectional view showing how a cap closes a filling port of the developer cartridge during an initial use according to a modification of the third embodiment.

As shown in FIG. 17A, protruding portions 223*b* and 224*b* may be formed on the tip end surfaces 223*a* and 224*a* of the filling-port inner cylindrical portion 223 and the filling-port outer cylindrical portion 224, respectively, similarly to the first embodiment.

In this case, during the initial use of the developer cartridge 31, the cap 177 is pressingly inserted in the filling-port inner cylindrical portion 223 as shown in FIG. 17A.

In order to refill toner for recycle use, similarly to the first embodiment, a tip end of the detachment tool is inserted between the flange portion 216 and the tip end surface 223*a* of the filling-port inner cylindrical portion 223. The cap 177 is easily detached from the filling-port inner cylindrical portion 223, without damaging the tip end surface 223*a* of the filling-port inner cylindrical portion 223, to open the filling port 76.

Figure 17B:
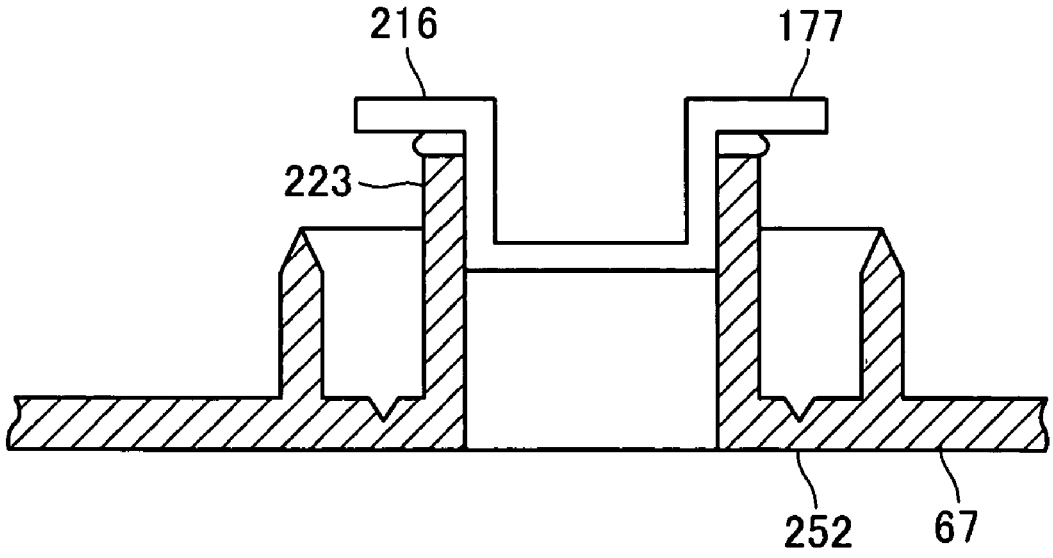
FIG. 17B is a cross-sectional view showing how the cap closes the filling port during a first recycle stage according to the modification of the third embodiment.

After refilling, as shown in FIG. 17B, similarly to the first embodiment, the cap 177 is pressingly fitted in the filling-port inner cylindrical portion 223. Then, ultrasonic welding is performed on the protruding portion 223*b* from the upper face of the flange portion 216 in FIG. 17B that is opposite to the surface of the flange portion 216 that contacts the protruding portion 223*b*. Thus, the protruding portion 223*b* and the surface of the flange portion 216 that contacts the protruding portion 223*b* are ultrasonically welded In this state, the developer cartridge 31 is reused for the first time.

Figure 17C:
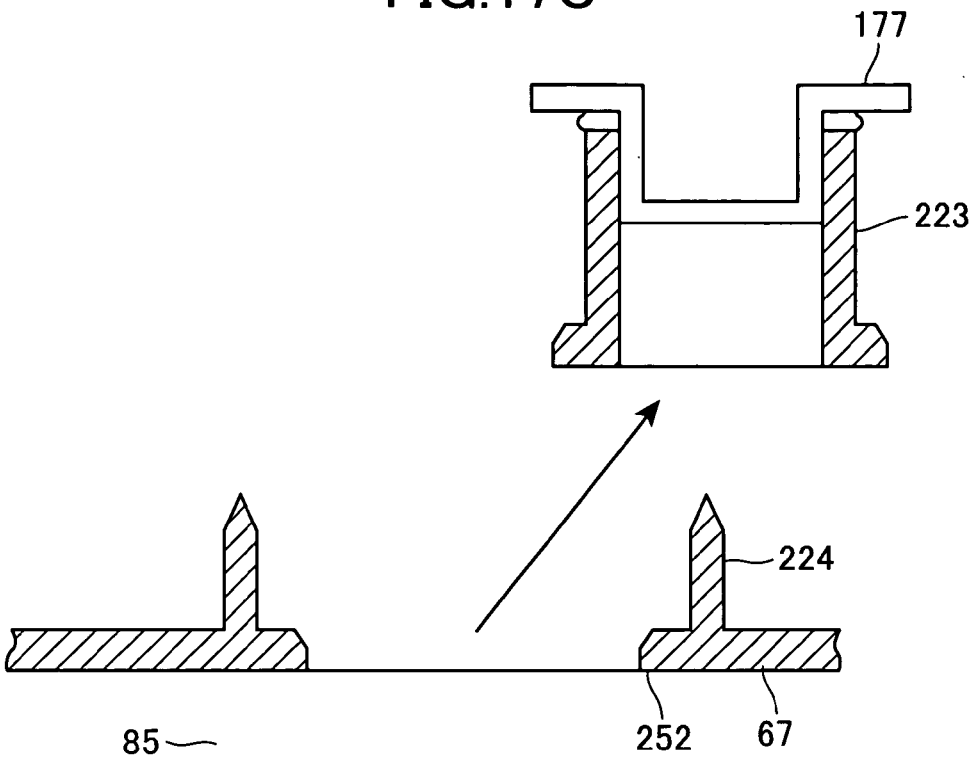
FIG. 17C is a cross-sectional view showing how the filling port is opened to refill toner in the developer cartridge to reuse the developer cartridge for the second recycle stage according to the modification of the third embodiment.

Next, in order to refill toner for the next recycle stage, similarly to the third embodiment, as shown in FIG. 17C, the filling-port inner cylindrical portion 223 is separated from the left side wall 67 by cutting the left side wall 67 along the groove 252.

Figure 17D:
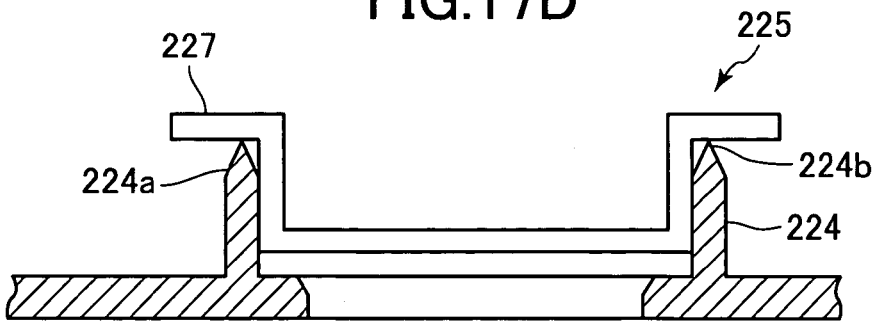
FIG. 17D is a cross-sectional view showing how a refilling cap closes the filling port during the second recycle stage according to the modification of the third embodiment.

After refilling, as shown in FIG. 17D, similarly to the third embodiment, the refilling cap 225 is pressingly inserted into the filling-port outer cylindrical portion 224. The flange portion 227 of the refilling cap 225 contacts the protruding portion 224*b* on the tip end surface 224*a* of the filling-port outer cylindrical portion 224. In this condition, the developer cartridge 31 is reused for the second time.

In order to refill toner for the third-time recycle use, similarly to the first embodiment, a tip end of the detachment tool is inserted between the flange portion 227 and the tip end surface 224*a* of the filling-port outer cylindrical portion 224. The refilling cap 225 is easily detached from the filling-port outer cylindrical portion 224, without damaging the tip end surface 224*a* of the filling-port outer cylindrical portion 224, to open the filling port 76.

Figure 17E:
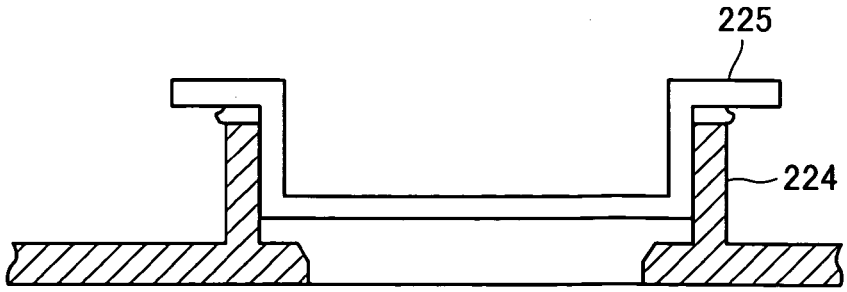
FIG. 17E is a cross-sectional view showing how the refilling cap closes the filling port during a third recycle stage according to the modification of the third embodiment.

After refilling, as shown in FIG. 17E, similarly to the first embodiment, the refilling cap 225 is pressingly fitted in the filling-port outer cylindrical portion 224. Then, ultrasonic welding is performed on the protruding portion 224*b* from the upper surface of the flange portion 227 in FIG. 17E that is opposite to the surface of the flange portion 227 that contacts the protruding portion 224*b*. Thus, the protruding portion 224*b* and the surface of the flange portion 227 that contacts the protruding portion 224*b* are ultrasonically welded. Thus, the developer cartridge 31 is reused for the third time.

In the above-described second through seventh embodiments and modifications, similarly to the fifth modification of the first embodiment, the outer diameter of the flange portion 216 of the cap 117 is greater than the outer diameter of each of the filling-port cylindrical portion 210, the filling-port inner cylindrical portion 223, and the filling-port cylindrical portion 233. Accordingly, the cap 117 can be easily removed from each filling-port cylindrical portion 210, 223, 233.

However, the outer diameter of the flange portion 216 may not be greater than the outer diameter of each filling-port cylindrical portion 210, 223, 233.

Alternatively, a protruding portion may be formed on at least one of the cap 117 and the tip end surface of each filling-port cylindrical portion 210, 223, 233, similarly to the first embodiment and first through fourth modifications of the first embodiment. Still in this case, the cap 117 can be easily removed.

In the above-described second through seventh embodiments and modifications, the filling-port cylindrical portion 210, the filling-port inner cylindrical portion 223, the filling-port outer cylindrical portion 224, the outer seat portion 229, and the filling-port cylindrical portion 233 are substantially of a circular cylindrical shape having a circular cross-section. However, they need not always have a circular cylindrical shape as long as they have a cylindrical shape that has the same cross-section over their entire axial lengths.

Although the present invention has been described with respect to specific embodiments, it will be appreciated by one skilled in the art that a variety of changes may be made without departing from the scope of the invention.

For example, each of the above embodiments has been described with reference to a developer cartridge 31. The developer cartridge 31 needs only to have a toner accommodating chamber 85. The supply roller 64, development roller 65, or layer-thickness regulation blade 66 may not be provided in the developer cartridge 31.

The developer cartridge 31 and the drum cartridge 30 may be fixedly secured into the process cartridge 22.

What is claimed is:

1. A cartridge, comprising:

a casing having a wall defining a developer accommodating portion inside the casing, a filling port being formed through the wall in fluid communication with the developer accommodating portion, developer being introduced through the filling port into the developer accommodating portion;

a cylindrical wall portion formed on the wall at a circumferential edge of the filling port and protruding from the wall outside the casing, the cylindrical wall portion having an inner peripheral surface, an outer peripheral surface, and an end surface positioned between the inner peripheral surface and the outer peripheral surface;

a closure member which is fitted in the cylindrical wall portion, while being in contact with the inner peripheral surface of the cylindrical wall portion, to close the filling port; and a protruding portion that is provided on at least one of the end surface and the closure member at its contact portion between the end surface and the closure member and that protrudes toward the other one of the end surface and the closure member.

2. The cartridge according to claim 1, wherein the closure member has a flange portion that confronts the end surface, and the protruding portion is formed on the end surface.

3. The cartridge according to claim 1, wherein the protruding portion is a stepped portion formed on the end surface of the cylindrical wall portion, and the closure member has a slope surface, at which the closure member contacts the stepped portion.

4. The cartridge according to claim 1, wherein the protruding portion is a circumferential edge portion between the end surface and the inner peripheral surface of the cylindrical wall portion, and the closure member has a slope surface, at which the closure member contacts the circumferential edge portion.

5. The cartridge according to claim 1, wherein the protruding portion is formed on the closure member, and a slope surface is formed on the end surface of the cylindrical wall portion at its position where the protruding portion contacts the end surface.

6. The cartridge according to claim 1, wherein the closure member has:

a flange portion that contacts the end surface of the cylindrical wall portion;

a closure-cylindrical portion that is of a cylindrical shape and that contacts the inner peripheral surface of the cylindrical wall portion; and a thinned portion that is formed between the flange portion and the closure-cylindrical portion and that is thinner than the flange portion and the closure-cylindrical portion.

7. The cartridge according to claim 1, wherein the closure member has a flange portion, the flange portion having a contact portion that contacts the end surface of the cylindrical wall portion and an extending portion that extends radially outwardly from the cylindrical wall portion.

8. The cartridge according to claim 1, further comprising a developer carrier that carries the developer.

9. The cartridge according to claim 8, further comprising an electrostatic latent image bearing body that is supplied with the developer from the developer carrier to develop an electrostatic latent image born on a surface of the electrostatic latent image bearing body.

10. The cartridge according to claim 1, wherein the closure member is pressingly fitted in the cylindrical wall portion after the developer is filled in the developer accommodating portion for the first time, and the closure member is ultrasonically welded at the protruding portion to the cylindrical wall portion after the developer is refilled in the developer accommodating portion for recycle use.

11. A cartridge, comprising:

a casing having a wall defining a developer accommodating portion inside the casing, a filling port being formed through the wall in fluid communication with the developer accommodating portion, developer being introduced through the filling port into the developer accommodating portion;

a cylindrical wall portion formed on the wall at a circumferential edge of the filling port and protruding from the wall outside the casing; and a closure member that closes the cylindrical wall portion to close the filling port, the closure member having a flange portion, the flange portion having a contact portion that contacts an end surface of the cylindrical wall portion and an extending portion that extends radially outwardly from the cylindrical wall portion.

wherein the closure member is pressingly fitted in the cylindrical wall portion after the developer is filled in the developer accommodating portion for the first time, and the closure member is welded at the extending portion to the cylindrical wall portion after the developer is refilled in the developer accommodating portion for recycle use.

12. The cartridge according to claim 11, wherein the closure member is ultrasonically welded at the extending portion to the cylindrical wall portion.

13. A cartridge, comprising:

a casing having a wall defining a developer accommodating portion inside the casing, a filling port being formed through the wall in fluid communication with the developer accommodating portion, developer being introduced through the filling port into the developer accommodating portion;

a cylindrical wall portion formed on the wall at a circumferential edge of the filling port and protruding from the wall outside the casing;

a closure member, whose part is inserted in the cylindrical wall portion while contacting at least a part of the cylindrical wall portion to close the filling port, the cylindrical wall portion having a through-hole at at least a part of its portion where the cylindrical wall portion contacts the closure member, thereby allowing the closure member to be exposed through the through-hole; and a protruding wall formed on the wall at a position opposing the through-hole in the cylindrical wall portion and protruding from the wall outside the casing.

14. The cartridge according to claim 13, wherein the closure member is pressingly fitted in the cylindrical wall portion after the developer is filled in the developer accommodating portion for the first time, and the closure member is ultrasonically welded to the cylindrical wall portion after the developer is refilled in the developer accommodating portion for recycle use.

15. A cartridge, comprising:

a casing having a wall defining a developer accommodating portion inside the casing, a filling port being formed through the wall in fluid communication with the developer accommodating portion, developer being introduced through the filling port into the developer accommodating portion;

a cylindrical wall portion formed on the wall at a circumferential edge of the filling port and protruding from the wall outside the casing; and a closure member that closes the cylindrical wall portion to close the filling port, the closure member being pressingly inserted in the cylindrical wall portion after the developer is filled in the developer accommodating portion for the first time, and the closure member being ultrasonically welded to the cylindrical wall portion after the developer is refilled in the developer accommodating portion for recycle use.

16. A method of using a cartridge, the method comprising:

preparing a cartridge including a casing having a wall defining a developer accommodating portion inside the casing, a filling port being formed through the wall in fluid communication with the developer accommodating portion, and a cylindrical wall portion formed on the wall at a circumferential edge of the filling port and protruding from the wall outside the casing;

filling developer in the developer accommodating portion through the filling port for the first time;

pressingly inserting a closure member in the cylindrical wall portion to close the filling port after developer is filled in the developer accommodating portion for the first time;

removing the closure member from the cylindrical wall portion and refilling the developer in the developer accommodating portion through the opened filling port;

refilling developer in the developer accommodating portion through the filling port for recycle use; and pressingly inserting the closure member in the cylindrical wall portion and ultrasonically welding the closure member to the cylindrical wall portion to close the filling port after the developer is refilled in the developer accommodating portion for recycle use.

17. The method according to claim 16, wherein the ultrasonic welding is effected on a protruding portion which is formed at a contact portion between the cylindrical wall portion and the closure member, the protruding portion being formed on at least one of the cylindrical wall portion and the closure member and which protrudes toward the other one of the cylindrical wall portion and the closure member.

18. The method according to claim 16, wherein the closure member has a flange portion whose outer diameter is greater than an outer diameter of the cylindrical wall portion, wherein when the closure member is pressingly inserted in the cylindrical wall portion, a ridially-inner part of the flange portion contacts an end surface of the cylindrical wall portion and a radially-outer part extends radially outwardly from the end surface of the cylindrical wall portion, the ultrasonic welding being effected on the extending portion.

19. The method according to claim 16, wherein a part of the closure member is inserted in the cylindrical wall portion while contacting at least a part of the cylindrical wall portion to close the filling port, the cylindrical wall portion having a through-hole at at least a part of its portion where the cylindrical wall portion contacts the closure member, thereby allowing the closure member to be exposed through the through-hole, the wall has a protruding wall at a position opposing the through-hole in the cylindrical wall portion and protruding from the wall outside the casing, and the removing includes pivoting a detachment tool about a tip end of the protruding wall while bringing a tip end of the detachment tool in contact with a part of the closure member that is exposed through the through-hole.

20. A method of recycling a used cartridge, the method comprising:

collecting a used cartridge including a casing having a wall defining a developer accommodating portion inside the casing, a filling port being formed through the wall in fluid communication with the developer accommodating portion, developer being filled in the developer accommodating portion through the filling port, and a cylindrical wall portion formed on the wall at a circumferential edge of the filling port and protruding from the wall outside the casing, a closure member being pressingly inserted in the cylindrical wall portion to close the filling port;

removing the closure member from the cylindrical wall portion and refilling the developer in the developer accommodating portion through the opened filling port;

refilling developer in the developer accommodating portion through the filling port for recycle use; and pressingly inserting the closure member in the cylindrical wall portion and ultrasonically welding the closure member to the cylindrical wall portion to close the filling port after the developer is refilled in the developer accommodating portion for recycle use.

21. The method according to claim 20, wherein the ultrasonic welding is effected on a protruding portion which is formed at a contact portion between the cylindrical wall portion and the closure member, the protruding portion being formed on at least one of the cylindrical wall portion and the closure member and which protrudes toward the other one of the cylindrical wall portion and the closure member.

22. The method according to claim 20, wherein the closure member has a flange portion whose outer diameter is greater than an outer diameter of the cylindrical wall portion, wherein when the closure member is pressingly inserted in the cylindrical wall portion, a ridially-inner part of the flange portion contacts an end surface of the cylindrical wall portion and a radially-outer part extends radially outwardly from the end surface of the cylindrical wall portion, the ultrasonic welding being effected on the extending portion.

23. The method according to claim 20, wherein a part of the closure member is inserted in the cylindrical wall portion while contacting at least a part of the cylindrical wall portion to close the filling port, the cylindrical wall portion having a through-hole at at least a part of its portion where the cylindrical wall portion contacts the closure member, thereby allowing the closure member to be exposed through the through-hole, the wall has a protruding wall at a position opposing the through-hole in the cylindrical wall portion and protruding from the wall outside the casing, and the removing includes pivoting a detachment tool about a tip end of the protruding wall while bringing a tip end of the detachment tool in contact with a part of the closure member that is exposed through the through-hole.

24. A cartridge, comprising:

a casing having a wall defining a developer accommodating portion inside the casing, a filling port being formed through the wall in fluid communication with the developer accommodating portion, developer being introduced through the filling port into the developer accommodating portion; and a receiving member provided on the wall, the receiving member having a first contact surface that receives a first cap member while in contact therewith to close the filling port when the first cap member is used to close the filling port, the receiving member further having a second contact surface that receives a second cap member while in contact therewith to close the filling port when the second cap member is used to close the filling port.

25. The cartridge according to claim 24, wherein the removal portion is the entire of the first cap member, the receiving member is formed in a cylindrical shape protruding from the wall outside the casing, the first contact surface is one of inner and outer peripheral surfaces of the receiving member, and the second contact surface is the other one of the inner and outer peripheral surfaces of the first receiving member.

26. The cartridge according to claim 24, wherein the removal portion is the entire of the first cap member, the receiving member is formed in a cylindrical shape protruding from the wall outside the casing, and is formed with a detaching-member insertion groove on its outer peripheral surface in its axial tip end part, the detaching-member insertion groove receiving a detaching member that is used for removing the first cap member, and the first contact surface is an inner peripheral surface of the receiving member at its axial tip end part, the second cap member has an insertion portion inserted in an axial base end part of the receiving member, and the second contact surface is an inner peripheral surface of the receiving member at the axial base end part.

27. The cartridge according to claim 24, wherein the receiving member includes:

a first receiving member provided on the casing and having the first contact surface; and a second receiving member provided on the casing and having the second contact surface.

28. The cartridge according to claim 27, further comprising a removal portion which is removed to open the filling port in a state in which the first cap member is received by the first receiving member.

29. The cartridge according to claim 28, wherein the removal portion includes at least a part of the first cap member.

30. The cartridge according to claim 29, wherein the first receiving member is formed in a cylindrical shape protruding from the wall outside the casing and having an inner peripheral surface that serves as the first contact surface, the first cap member has a cylindrical portion inserted in the first receiving member and a closure portion that closes an axial end of the cylindrical portion, and the removal portion includes at least a part of the closure portion.

31. The cartridge according to claim 30, wherein the second receiving member is formed in a cylindrical shape protruding from the wall outside the casing and surrounding outer circumference of the first receiving member, the second cap member has an insertion portion inserted in the second receiving member, and the second contact surface includes an inner peripheral surface of the second receiving member.

32. The cartridge according to claim 29, wherein the removal portion is the entire of the first cap member, the second receiving member is formed in a cylindrical shape protruding from the wall outside the casing, the first receiving member is provided joined to an axial end of the second receiving member, is in a cylindrical shape having an inner peripheral surface continuous from an inner peripheral surface of the second receiving member, and has a detaching-member insertion portion that receives a detaching member that is used for removing the first cap member, and the first contact surface is an inner peripheral surface of the first receiving member.

33. The cartridge according to claim 32, wherein the second cap member has an insertion portion inserted in the second receiving member, and the second contact surface is the inner peripheral surface of the second receiving member.

34. The cartridge according to claim 29, wherein the removal portion is the entire of the first cap member, the first receiving member is in a cylindrical shape protruding from the wall outside the casing, and serves as the second receiving member, the first contact surface is one of inner and outer peripheral surfaces of the first receiving member, and the second contact surface is the other one of the inner and outer peripheral surfaces of the first receiving member.

35. The cartridge according to claim 28, wherein the removal portion includes the first cap member and at least a part of the first receiving member, the part being to be cut and removed together with the first cap member.

36. The cartridge according to claim 35, wherein the first receiving member is formed in a cylindrical shape protruding from the wall outside the casing, the first contact surface is an inner peripheral surface of an axial tip end part of the first receiving member, and the removal portion includes the first cap member and the axial tip end part of the first receiving member.

37. The cartridge according to claim 36, wherein the second receiving member is a remaining part of the first receiving member that remains after the axial tip end part is removed, the second cap member has an insertion portion inserted in the second receiving member, and the second contact surface is an inner peripheral surface of the second receiving member.

38. The cartridge according to claim 35, wherein the first receiving member is formed in a cylindrical shape protruding from the wall outside the casing, the first contact surface is an inner peripheral surface of the first receiving member, and the removal portion includes the first cap member and the entire first receiving member.

39. The cartridge according to claim 38, wherein the second receiving member is formed protruding from the wall outside the casing and surrounding an outer circumference of the first receiving member.

40. The cartridge according to claim 39, wherein the second receiving member is formed in a cylindrical shape, the second cap member has an insertion portion which is inserted in the second receiving member, and a flange portion extending radially outwardly from the insertion portion, and the second contact surface includes:

an inner peripheral surface of the second receiving member; and one end surface that contacts the flange portion when the second cap member is received on the second receiving member.

41. The cartridge according to claim 39, wherein the second receiving member is formed in a ring shape, the second cap member has an insertion portion inserted in the filling port, and a flange portion extending radially outwardly from the insertion portion, and the second contact surface is a surface of the ring-shaped second receiving member that contacts the flange portion when the second cap member is received on the second receiving member.

42. A combination of a cartridge, a first cap member, and a second cap member, comprising:

a cartridge including:

a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing;

a first cap member mounted on one of inner and outer peripheral surfaces of the cylindrical wall portion; and a second cap member mounted on the other one of inner and outer peripheral surfaces of the cylindrical wall portion.

43. A combination of a cartridge, a first cap member, and a second cap member, comprising:

a cartridge including:

a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing, the cylindrical wall portion having a groove on its outer peripheral surface in its axial tip end part, the groove extending along an axis of the cylindrical wall portion;

a first cap member mounted on an inner peripheral surface of the cylindrical wall portion at its axial tip end part; and a second cap member mounted on the inner peripheral surface of the cylindrical wall portion at its axial base end part.

44. A combination of a cartridge, a first cap member, and a second cap member, comprising:

a cartridge including:

a casing having a wall defining a developer accommodating portion inside the casing, a filling port being formed through the wall in fluid communication with the developer accommodating portion, developer being introduced through the filling port into the developer accommodating portion; and a cylindrical wall portion provided on the wall to protrude from a circumferential edge of the filling port in a direction outside the casing, the cylindrical wall portion having a base-end-side part on an axial base end side thereof and a tip-end-side part on an axial tip end side thereof, the tip-end-side part being thinner than the base-end-side part;

a first cap member mounted on an inner peripheral surface of the tip-end-side part of the cylindrical wall portion; and a second cap member mounted on the inner peripheral surface of the base-end-side part of the cylindrical wall Portion.

45. A cartridge, comprising:

a casing having a wall defining a developer accommodating portion inside the casing, a filling port being formed through the wall in fluid communication with the developer accommodating portion, developer being introduced through the filling port into the developer accommodating portion; and an inner cylindrical wall portion provided on the wall to protrude from a circumferential edge of the filling port in a direction outside the casing; and an outer cylindrical wall portion provided on the wall separately from the inner cylindrical wall portion to protrude in a direction outside the casing, the outer cylindrical wall portion surrounding the inner cylindrical wall portion.

46. A cartridge according to claim 45, wherein the outer cylindrical wall portion extends longer than the inner cylindrical wall portion.

47. A cartridge according to claim 45, wherein the outer cylindrical wall portion extends shorter than the inner cylindrical wall portion.

48. A cartridge according to claim 45, wherein a groove is formed on the wall at a location between the outer cylindrical wall portion and the inner cylindrical wall portion and surrounding an outer circumference of the inner cylindrical wall portion.

49. A cap member, comprising:

a hollow cylindrical portion;

a flange portion extending radially outwardly from one axial end of the cylindrical portion; and a bottom portion closing the other axial end of the cylindrical portion and having a groove along a circumferential edge of the bottom portion.

50. A method of recycling a used cartridge, the method comprising:

collecting a used cartridge including a casing having a wall defining a developer accommodating portion inside the casing, a filling port being formed through the wall in fluid communication with the developer accommodating portion, and a receiving member provided on the wall, the receiving member having a first contact surface and a second contact surface, a first cap member being received on the receiving member while being in contact with the first contact surface and closing the filling port;

removing at least a part of the first cap member to open the filling port;

refilling developer in the developer accommodating portion through the opened filling port; and bringing a second cap member into contact with the second contact surface after refilling the developer in the developer accommodating portion, to thereby close the filling port.

51. The method according to claim 50, wherein the receiving member includes:

an inner cylindrical wall portion provided on the wall to protrude from a circumferential edge of the filling port in a direction outside the casing; and an outer cylindrical wall portion provided on the wall to protrude in a direction outside the casing, the outer cylindrical wall portion surrounding the inner cylindrical wall portion, and wherein the first cap member is mounted on the inner cylindrical wall portion.

52. The method according to claim 51, wherein the removing cuts out the inner cylindrical wall portion from the cartridge and removes the inner cylindrical wall portion and the first cap member mounted thereon together.

53. The method according to claim 51, wherein the first cap member includes:

a hollow cylindrical portion;

a flange portion extending radially outwardly from one axial end of the cylindrical portion; and a bottom portion closing the other axial end of the cylindrical portion, the hollow cylindrical portion being inserted in the inner cylindrical wall portion and the flange portion contacting a tip end surface of the inner cylindrical wall portion, and the removing cuts out the bottom portion along its circumferential edge from the first cap member and removes the cut out bottom portion.

54. The method according to claim 50, wherein the receiving member is formed in a cylindrical shape protruding from a circumferential edge of the filling port in a direction outside the casing, the first cap member is mounted contacting one of inner and outer peripheral surfaces of the cylindrical-shaped receiving member, the entire part of the first cap member is removed to open the filling port, and the second cap member is mounted contacting the other one of inner and outer peripheral surfaces of the cylindrical-shaped receiving member.

55. The method according to claim 50, wherein the receiving member is formed in a cylindrical shape protruding from a circumferential edge of the filling port in a direction outside the casing, and has a detaching-member insertion groove on its outer peripheral surface in its axial tip end part, the first cap member contacting an inner peripheral surface of the cylindrical-shaped receiving member at its axial tip end part, the removing includes inserting detaching member through the detaching-member insertion groove to remove the entire part of the first cap member from the receiving member, and a part of the second cap member is inserted into an axial base end part of the cylindrical-shaped receiving member to bring the part of the second cap member into contact with the inner peripheral surface of the receiving member at its axial base end part.

56. A method of using a cartridge, the method comprising:

preparing a cartridge including a casing having a wall defining a developer accommodating portion inside the casing, a filling port being formed through the wall in fluid communication with the developer accommodating portion, and a receiving member provided on the wall, the receiving member having a first contact surface and a second contact surface;

filling developer in the developer accommodating portion through the opened filling port;

bringing a first cap member into contact with the first contact surface after filling the developer in the developer accommodating portion, to thereby close the filling port;

removing at least a part of the first cap member, to open the filling port;

refilling developer in the developer accommodating portion through the opened filling port; and bringing a second cap member into contact with the second contact surface after refilling the developer in the developer accommodating portion, to thereby close the filling port.

57. A method of using a cartridge, the method comprising:

preparing a cartridge including a casing having a wall defining a developer accommodating portion inside the casing, a filling port being formed through the wall in fluid communication with the developer accommodating portion, and at least one cylindrical wall portion protruding from the wall in a direction outside the casing and surrounding the filling port, the at least one cylindrical wall portion including a first cylindrical wall portion;

filling developer in the developer accommodating portion through the opened filling port;

after filling the developer in the developer accommodating portion, pressingly fitting a first cap member into one of the at least one cylindrical wall portion, while bringing the first cap member into contact with a first part in a surface of the first cylindrical wall portion, to thereby close the filling port;

removing at least a part of the first cap member, to open the filling port;

refilling developer in the developer accommodating portion through the opened filling port;

selecting either one of the first cap member and a second cap member different from the first cap member; and after refilling the developer, mounting the selected cap member into either one of the at least one cylindrical wall portion in a manner that when the selected cap member is the first cap member, the first cap member is pressingly inserted into the first cylindrical wall portion and is ultrasonically welded to the first cylindrical wall portion and that when the selected cap member is the second cap member, the second cap member is pressingly inserted into one of the at least one cylindrical wall portion, while bringing the second cap member into contact with a second part in a surface of the either one of the at least one cylindrical wall portion, the second part being different from the first part, to thereby close the filling port.

58. A method according to claim 57, wherein the removing includes removing the first cylindrical wall portion and the first cap member together, and the selecting includes selecting the second cap member.

59. A method according to claim 57, wherein the removing includes removing at least a part of the first cylindrical wall portion and at least a part of the first cap member together, and the selecting includes selecting the second cap member.

60. A method according to claim 57, wherein the removing includes removing a part of the first cap member, without removing any part of the first cylindrical wall portion, and the selecting includes selecting the second cap member.

61. A method according to claim 57, wherein the removing includes removing the entire part of the first cap member, without removing any part of the first cylindrical wall portion, and the selecting includes selecting the second cap member.

62. A method according to claim 57, wherein the removing includes removing the entire part of the first cap member, without removing any part of the first cylindrical wall portion, and the selecting includes selecting the first cap member.

* * * * *